US005766821A

United States Patent [19]

Muramatsu et al.

[11] Patent Number: 5,766,821

[45] Date of Patent: Jun. 16, 1998

[54] BLACK-AND-WHITE SILVER HALIDE PHOTOGRAPHIC LIGHT-SENSITIVE MATERIAL

[75] Inventors: Yasuhiko Muramatsu; Takeshi Sampei, both of Hino, Japan

[73] Assignee: Konica Corporation, Japan

[21] Appl. No.: 828,583

[22] Filed: Mar. 31, 1997

[30] Foreign Application Priority Data

Apr. 4, 1996 [JP] Japan ..... 8-082595

[51] Int. Cl.[6] ..... G03C 1/76

[52] U.S. Cl. ..... 430/264; 430/523; 430/950

[58] Field of Search ..... 430/264, 523, 430/950

[56] References Cited

U.S. PATENT DOCUMENTS

| | | | |
|---|---|---|---|
| 5,175,073 | 12/1992 | Gingello et al. | 430/264 |
| 5,591,561 | 1/1997 | Arai et al. | 430/264 |
| 5,616,446 | 4/1997 | Miura et al. | 430/264 |
| 5,618,661 | 4/1997 | Sampei | 430/264 |
| 5,667,936 | 9/1997 | Yamada et al. | 430/264 |

FOREIGN PATENT DOCUMENTS 0679938 2/1995 European Pat. Off. .

*Primary Examiner*—Hoa Van Le

*Attorney, Agent, or Firm*—Jordan B. Bierman; Bierman, Muserlian and Lucas

[57] ABSTRACT

A black-and-white silver halide photographic light-sensitive material is disclosed. The black-and-white silver halide photographic light-sensitive material comprises a support having thereon a light-sensitive silver halide emulsion layer and at least two non-light-sensitive hydrophilic colloid layers provided on the surface of the silver halide emulsion layer farther from said support, in which the silver halide emulsion layer comprises silver halide grains each having a silver chloride content of 90 mole-% to 100 mole-% and containing a metal selected from the group consisting of transition metal of Group VIII of the periodic table and rhenium, a layer provided on the emulsion layer coated side of the support contains a hydrazine derivatives and a layer provided on the emulsion layer coated side of the support contains an amine compounds or an onium compounds as a nucleation accelerating agent, and the total dry thickness of layers provided on the surface farther from the support of the silver halide emulsion layer which is provided nearest to the support is 2.5 μm to 8 μm.

8 Claims, 1 Drawing Sheet

BLACK-AND-WHITE SILVER HALIDE PHOTOGRAPHIC LIGHT-SENSITIVE MATERIAL

FIELD OF THE INVENTION

The present invention relates to a black-and-white silver halide photographic light-sensitive material and a processing method for the light-sensitive material, particularly relates to a black-and-white silver halide photographic light-sensitive material for graphic art and a processing method for it.

BACKGROUND OF THE INVENTION

In a black-and-white silver halide photographic light-sensitive material, particular one to be used for graphic art, a photographic property of high contrast is required to reproduce a halftone image or line image with a high fidelity. There are various techniques for obtaining the high contrast, for example, a method described in U.S. Pat. No. 4,269,929 is known by which a silver halide photographic material containing a hydrazine derivative is processed.

In the field of graphic arts, the light-sensitive material is required to be excellent in the reproducibility of a small halftone dot and a width of a white line image on a halftone background, so called a reproducibility of white letter on halftone background, when the light-sensitive material is used for printing a transparent original by a printer.

Further a photographic material is required to have a stability of photographic properties during the storage of the light-sensitive material since the photographic properties of silver halide light-sensitive material tends to be varied under a high temperature and high humid conditions.

In the light-sensitive material using only the above-mentioned technique for obtaining the high contrast property, the reproducibility of white letter on halftone background is not satisfactory and problems such as degradation of the reproducibility of white letter on halftone background, changing in the sensitivity and formation of white spot defects are occurred during the storage of the light-sensitive material.

In the field of graphic arts, a demand to shorten the processing time of the light-sensitive material is increasingly strengthen for shortening the working time accompanied with improvement of the working environment. Generally, black-and-white light-sensitive material is processed by an automatic processor having at least a developing portion, fixing portion, washing or stabilizing portion and drying portion. Although the processing time is ordinary 60 seconds or more, it is demanded to shorten the processing time to 50 seconds or less by the above-mentioned reason.

At the present state, the reproducibility of white letter on halftone background, sensitivity variation and white spot defect are further degraded when the total processing time is shortened to 50 seconds or less.

SUMMARY OF THE INVENTION

An object of the invention is to provide a black-and-white silver halide photographic light-sensitive material containing a hydrazine derivative which is excellent in the reproducibility of white letter on halftone background.

Another object of the invention is to provide a black-and-white silver halide photographic light-sensitive material inhibited in degradation of the reproducibility of white letter on halftone background, sensitivity variation and formation of white spots, so-called white spot defect during the storage of the light-sensitive material.

Another object of the invention is to provide a black-and-white silver halide photographic light-sensitive material and a processing method therefor by which the degradation of the reproducibility of white letter on halftone background, variation of the sensitivity and formation of pin-hole like white spot defect in halftone image during storage of the light-sensitive material when the light-sensitive material is subjected to a rapid processing spending not more than 50 minutes for developing to drying in total.

The above objects of the invention are attained by a black-and-white silver halide photographic light-sensitive material comprising a support having thereon a light-sensitive silver halide emulsion layer and at least two non-light-sensitive hydrophilic colloid layers provided on the surface of the silver halide emulsion layer farther from said support, in which the silver halide emulsion layer comprises silver halide grains each having a silver chloride content of 90 mole-% to 100 mole-% and containing a metal selected from the group consisting of transition metal of Group VIII of the periodic table and rhenium, a layer provided on the emulsion layer coated side of the support contains a hydrazine derivatives and a layer provided on the emulsion layer coated side of the support contains an amine compounds or an onium compounds as a nucleation accelerating agent, and the total dry thickness of layers provided on the surface farther from the support of the silver halide emulsion layer which is provided nearest to the support is 2.5 μm to 8 m.

DETAILED DESCRIPTION OF THE INVENTION

Figure 1:
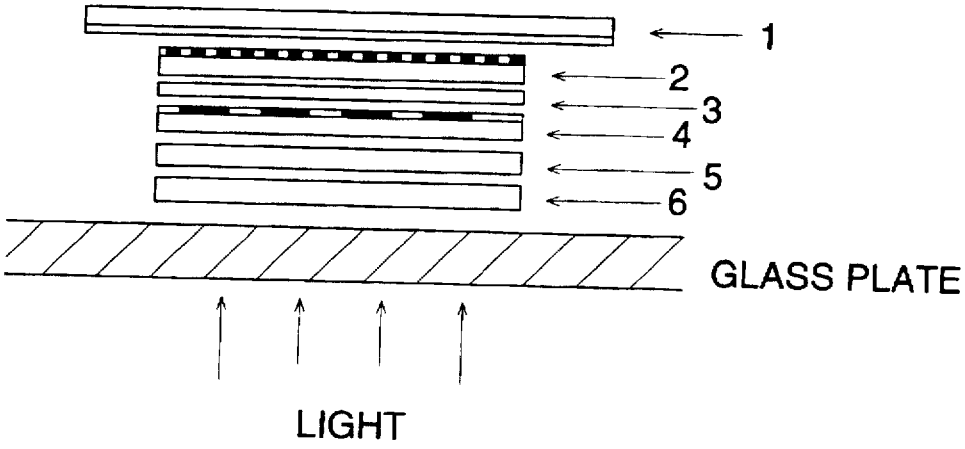
FIG. 1. shows the method for exposure used for evaluating the reproducibility of white letter on halftone gackground.

In the invention, a compound represented by the following Formula H is preferred as the hydrazine derivative.

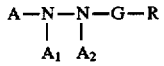

Formula H

In the formula, A is an aryl group or a heterocyclic group having at least one sulfur atom or oxygen atom; G represents a $—(CO)_n—$group, a sulfonyl group, a $—P(=O)R_2—$group or an iminomethylene group; n represents an integer of 1 or 2; $A_1$ and $A_2$ are hydrogen atoms, or one of $A_1$ and $A_2$ is a hydrogen atom and the other one of them is an alkylsulfonyl group or an acyl group, the alkylsulfonyl group and acyl group each may have a substituent; and R is a hydrogen atom, an alkyl group, an alkenyl group, an aryl group, an alkoxy group, an alkenyloxy group, an aryloxy group, a heterocyclic oxy group, an amino group, a carbamoyl group or an oxycarbonyl group, the above-mentioned groups represented by R each may have a substituent. $R_2$ represents an alkyl group, an alkenyl group, an alkynyl group, an aryl group, an alkoxy group, an alkenyloxy group, an alkynyloxy group, an aryloxy group or an amino group, the above-mentioned groups represented by $R_2$ each may have a substituent.

Among the compounds represented by Formula H, ones represented by the following Formula Ha are more preferred.

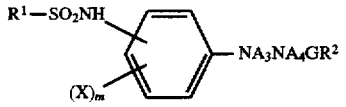

Formula Ha

In the formula, $R^1$ is an aliphatic group such as octyl group and decyl group, an aromatic group such as phenyl group, 2-hydroxyphenyl group and chlorophenyl group, or a heterocyclic group such as pyridyl group, thienyl group of furyl group, and the above groups each preferably having an appropriate substituent. It is preferred that $R^1$ includes a ballast group or a group accelerating adsorption to silver halide.

As an anti-diffusion group, a ballast group ordinary used in a immovable photographic additive such as a coupler is preferable. The ballast group includes groups having 8 or more carbon atoms and being photographically relatively inactive, for example, an alkyl group, an alkenyl group, an alkynyl group, an alkoxy group, a phenyl group, a phenoxy group and an alkylphenoxy group.

As the group accelerating adsorption to silver halide, a thiourea group, a thiourethane group, a mercapto group, a thioether group, a heterocyclic group, a thioamidoheterocyclic group, a mercaptoheterocyclic group and ones described in Japanese Patent Publication for Public Inspection (JP O.P.I.) No. 64-90439/1989 are cited.

In Formula Ha, X is a group capable of being a substituent of the phenyl group; m is an integer of 0 to 4, and the groups represented by X may be the same or different when m is 2 or more.

In Formula Ha, $A_3$ and $A_4$ are each the same as $A_1$ and $A_2$ in Formula H, respectively, and it is preferred that both of $A_3$ and $A_4$ are hydrogen atoms.

In Formula Ha, G is a carbonyl group, a sulfonyl group, a sulfoxy group, a phosphoryl group or a iminomethylene group, and the carbonyl group is preferred.

In Formula Ha, $R^2$ is a hydrogen atom, an alkyl group, an alkenyl group, an alkynyl group, an aryl group, a heterocyclic group, an alkoxy group, a hydroxyl group, an amino group, a carbamoyl group or an oxycarbonyl group. As the most preferable group represented by $R^2$, a —$COOR^3$ group and a —$CON(R^4)(R^5)$ group are cited, in which $R^3$ is an alkynyl group or a saturated heterocyclic group, $R^4$ is a hydrogen atom, an alkyl group, an alkenyl group, an alkynyl group, an aryl group or a saturated heterocyclic group, $R^5$ is a hydrogen atom, an alkyl group or an alkoxy group.

Concrete examples of compound represented by Formula [H] are shown below. The invention is not limited thereto.

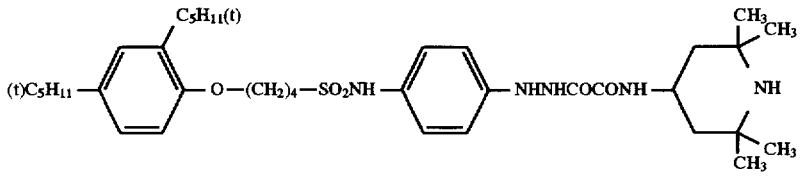

H-1

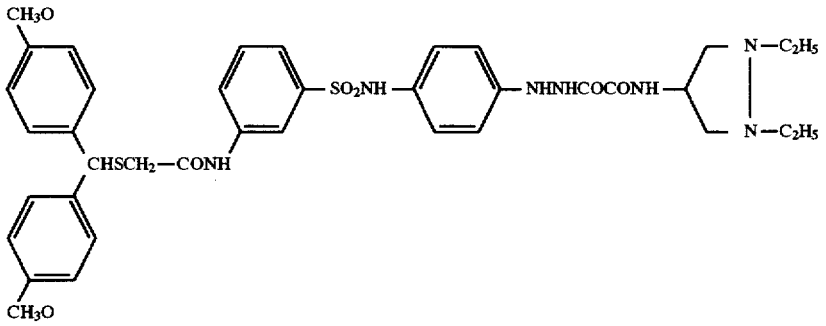

H-2

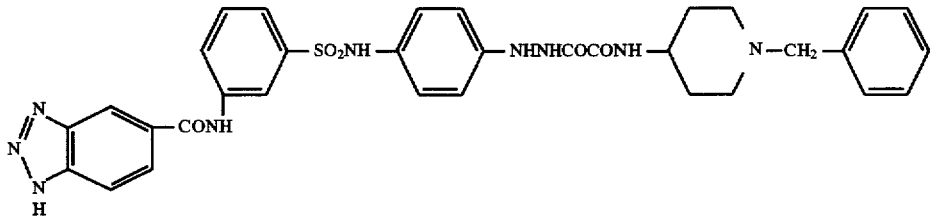

H-3

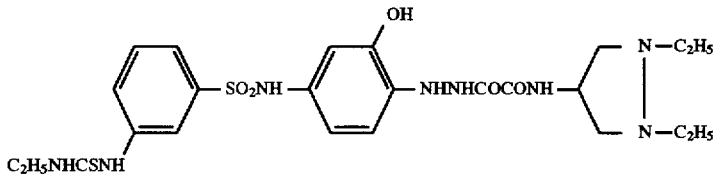

H-4

-continued
H-5
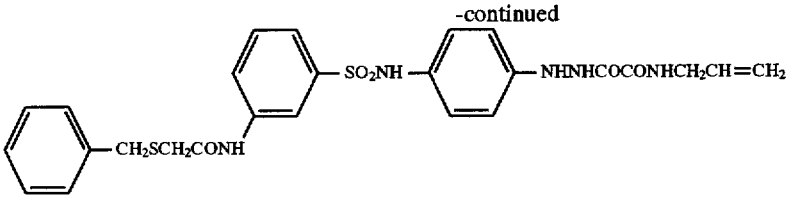
H-6
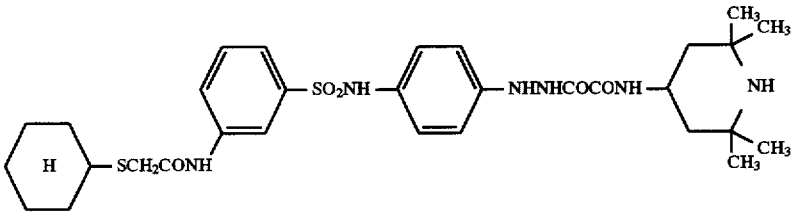
H-7
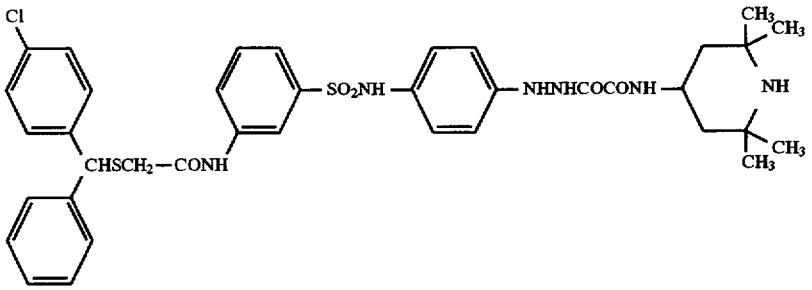
H-8
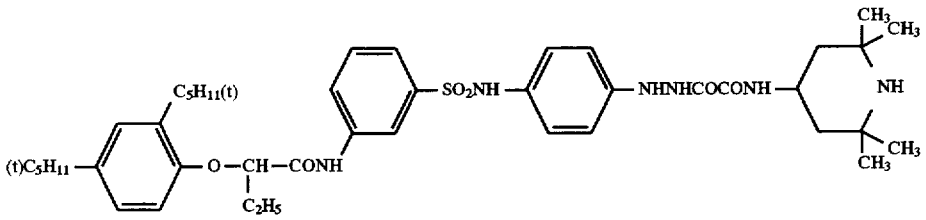
H-9
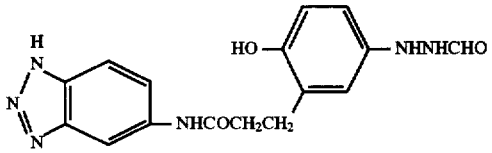
H-10
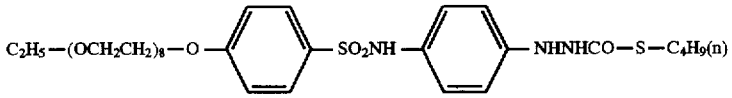
H-11
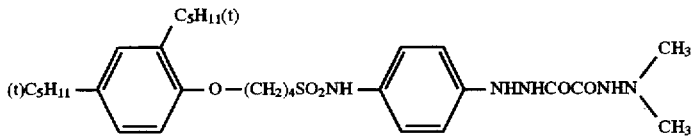
H-12
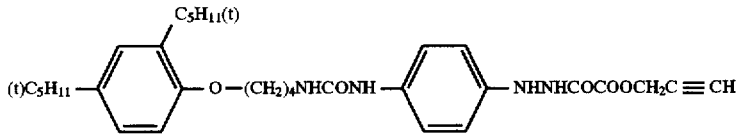
H-13
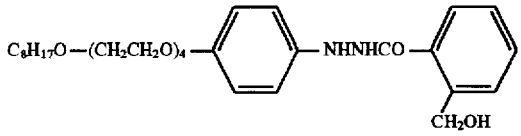

-continued
H-14
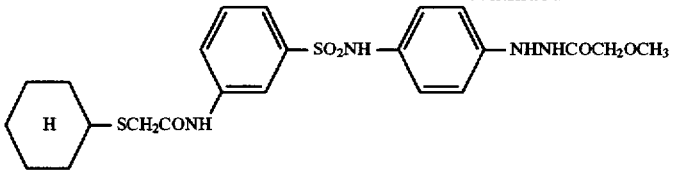
H-15
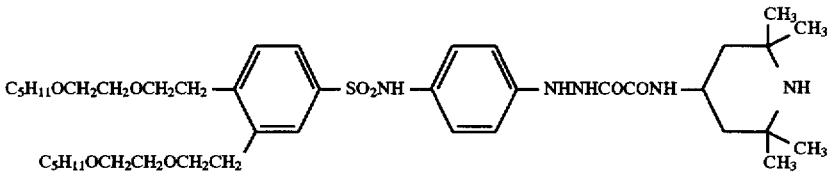
H-16
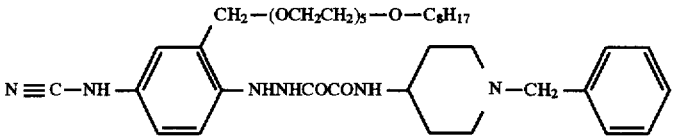
H-17
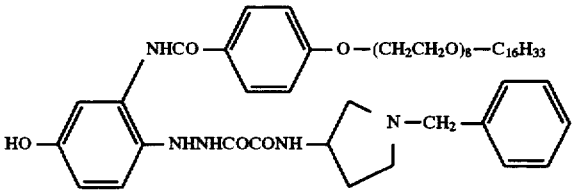
H-18
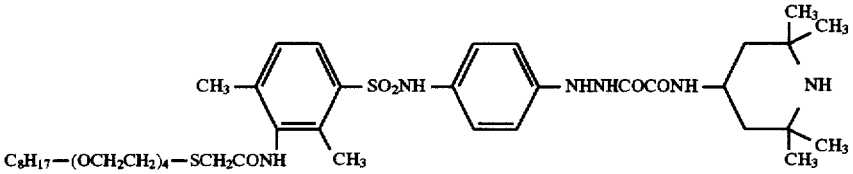
H-19
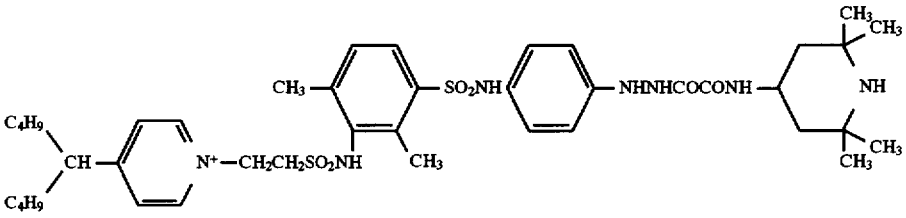
H-20
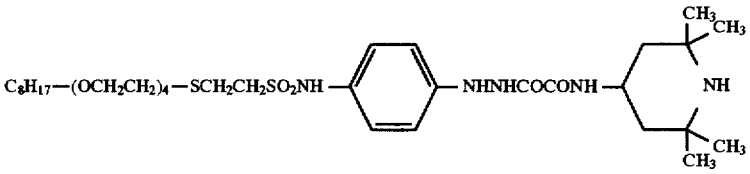
H-21
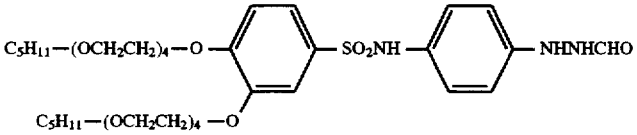
H-22
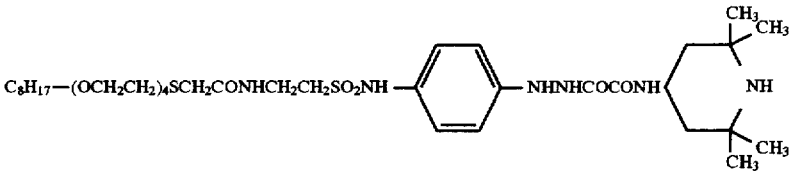

-continued
H-23
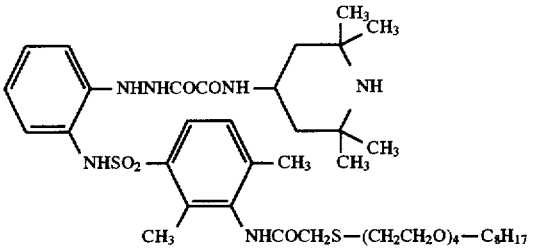
H-24
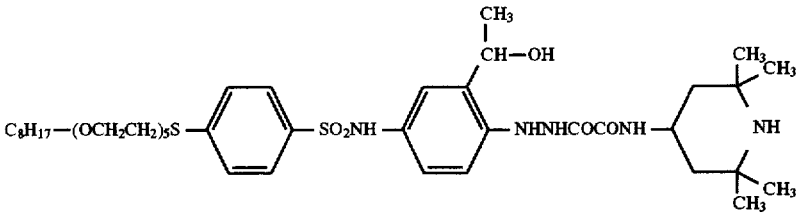
H-25
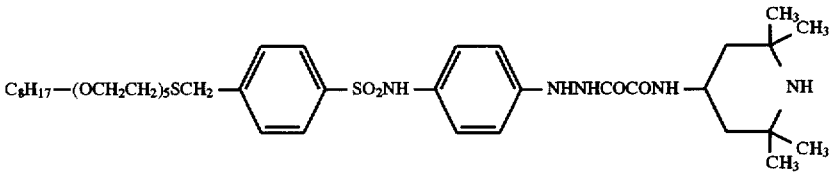
H-26
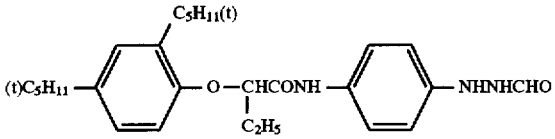
H-27
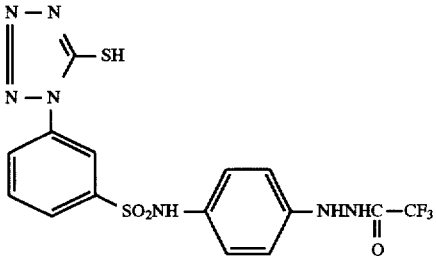
H-27
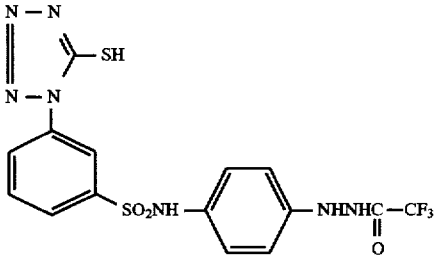
H-28
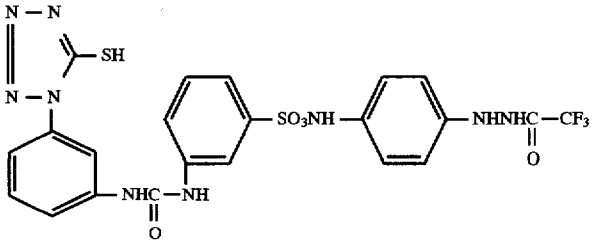

-continued
H-29
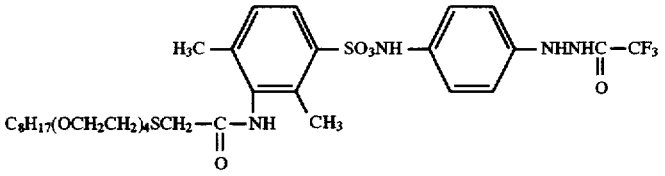
H-30
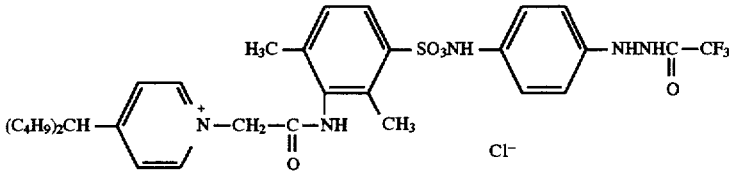
H-31
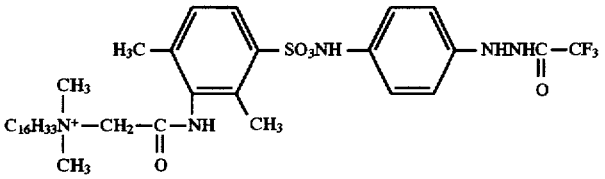
H-32
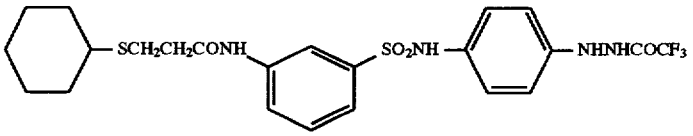
H-33
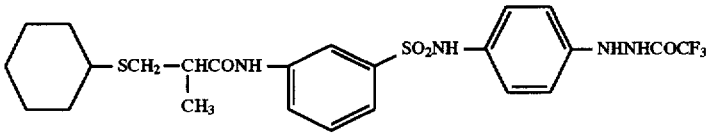
H-34
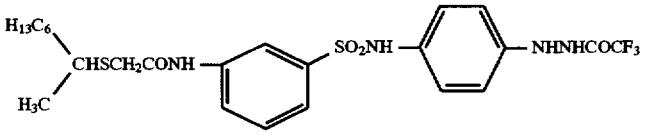
H-35
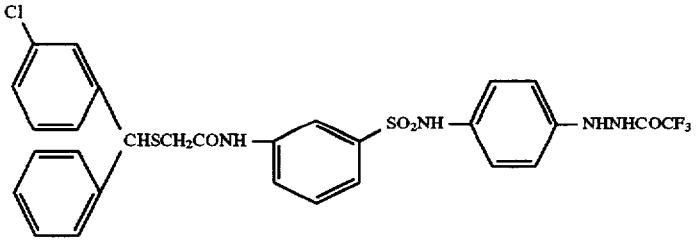
H-36
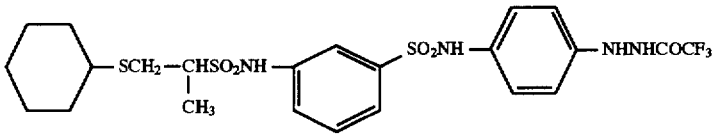
H-37
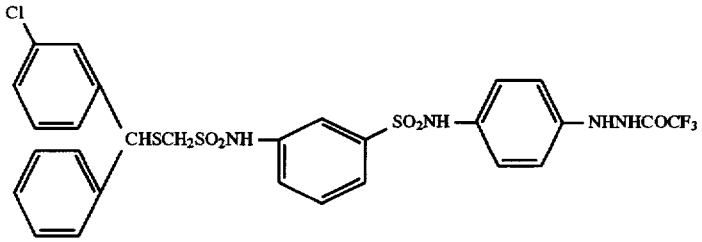

-continued

H-38

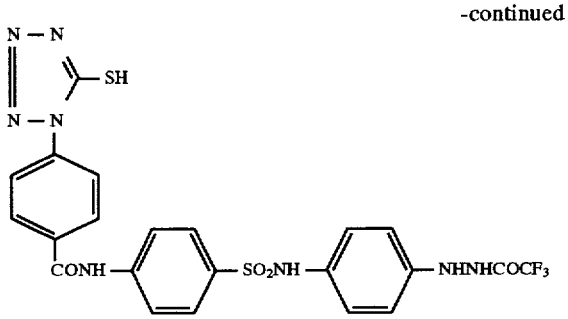

H-39

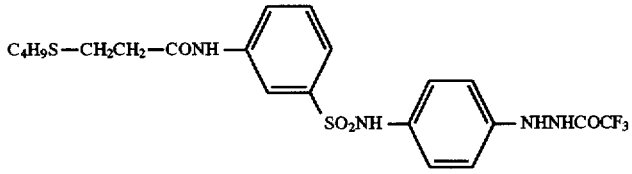

H-40

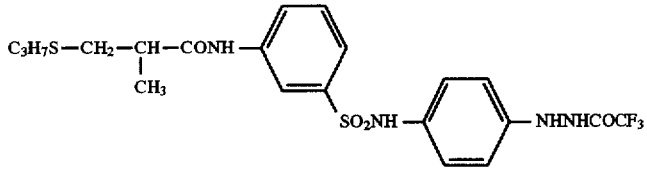

Concrete preferable examples of the hydrazine derivative other than the above are Compounds (1) to (252) described in U.S. Pat. No. 5,229,248, columns 4 to 60.

The hydrazine derivatives related to the invention can be synthesized by known methods, for example, the method described in U.S. Pat. No. 5,229,248, columns 59 to 80.

The adding amount may be the amount satisfactory to make the high contrast and the optimum amount is varied depending on the diameter of silver halide grain, the composition of silver halide, the degree of chemical sensitization and the kind of inhibitor. The adding amount is usually within the range of from $10^{-6}$ moles to $10^{-1}$ moles, preferably $10^{-5}$ moles to $10^{-2}$ moles, per mole of silver halide.

The hydrazine derivatives used in the invention is added to a silver halide emulsion layer or a layer adjacent to the silver halide emulsion layer.

It is preferred to add at least one kind of nucleation accelerating agent selected from the group consisting of quartenary onium compounds each having a quartenary nitrogen atom and/or a quartenary phosphor atom in the structure thereof and amine compounds.

The quartenary onium compound usable in the invention is a compound having a quartenary cationic group of nitrogen atom or phosphor atom in the molecule thereof, and a compound represented by Formula P is preferable.

Formula P

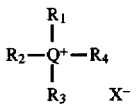

In the formula, Q is a nitrogen atom or a phosphor atom; $R_1$, $R_2$, $R_3$ and $R_4$ are each an hydrogen atom or a substituent, respectively; $X^-$is an anion. $R_1$ to $R_4$ may be link with each other to form a ring.

The substituent represented by $R_1$ to $R_4$ includes an alkyl group, an alkenyl group, an aryl group, a heterocyclic group and an amino group, in concrete, an alkyl group such as methyl group, ethyl group, propyl group, butyl group, hexyl group and cyclohexyl group, an alkenyl group such as allyl group and butenyl group, an alkynyl group such as propargyl group and butynyl group, an aryl group such as phenyl group and naphthyl group, a heterocyclic group such as a piperidinyl group, piperazinyl group, morpholinyl group, pyridinyl group, furyl group, thienyl group, tetrahydrofuryl group, tetrahydrothienyl group and sulforanyl group.

The ring formed by linking of $R_2$ to $R_4$ includes a piperidine ring, morpholine ring, quinacridine ring and pyridine ring.

The groups represented by $R_1$ to $R_4$ each may have a substituent such as a hydroxyl group, an alkoxy group, an aryloxy group, a carboxyl group, a sulfo group, an alkyl group or an aryl group.

$R_1$, $R_2$, $R_3$ and $R_4$ are each preferably a hydrogen atom or an alkyl group.

The anion represented by $X^-$ includes an inorganic or organic ion such as a halogen ion, sulfate ion, nitrate ion, acetate ion or p-toluenesulfonate ion.

Pyridinium compounds represented by the following Formulas Pa, Pb or Pc are further preferred.

Formula (Pa)

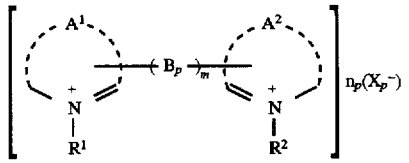

Formula (Pb)

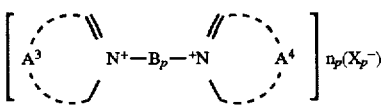

-continued

Formula (Pc)

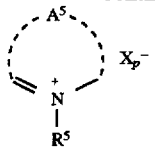

In the formula, $A^1$, $A^2$, $A^3$, $A^4$ and $A^5$ are each a group of non-metallic atoms necessary to complete the nitrogen containing heterocyclic ring, the heterocyclic ring may contain an oxygen atom, a nitrogen atom or a sulfur atom and may be condensed with a benzene ring. The heterocyclic ring represented by $A^1$, $A^2$, $A^3$, $A^4$ and $A^5$ may be the same or different and may have a substituent. The substituent includes an alkyl group, an aryl group, an aralkyl group, an alkenyl group, an alkynyl group, a halogen atom, an acyl group, an alkoxycarbonyl group, an aryloxycarbony group, a sulfo group, a carboxyl group, a hydroxyl group, an alkoxy group, an aryloxy group, an amido group, a sulfamoyl group, a carbamoyl group, a ureido group, an amino group, a sulfonamido group, a sulfonyl group, a cyano group, a nitro group, a mercapto group, an alkylthio group or an arylthio group. Preferable example of $A^1$, $A^2$, $A^3$, $A^4$ and $A^5$ include a 6-member ring such as a pyridine ring, imidazole ring, thiazole ring, oxazole, pyrazine ring and pyrimidine ring), more preferable example is a pyridine ring.

$B_p$ is a di-valent linking group and m represents 0 or 1. The di-valent linking group is an alkylene group, an arylene group, an alkenylene group, an —$SO_2$—group, an —SO—group, an —O—, an —S—, a —CO—group or an —N($R^6$)—group, in which $R^6$ is an alkyl group, an aryl group or a hydrogen atom, or combination thereof. $B_p$ is preferably an alkylene group or an alkenylene group.

$R^1$, $R^2$ and $R^5$ are each an alkyl group having 1 to 20 carbon atoms. $R^1$ and $R^2$ may be the same or different. The alkyl group may has a substituent. The substituent is the same a that described as the substituent of $A^1$, $A^2$, $A^3$, $A^4$ and $A^5$.

Preferable example of $R^1$, $R^2$ and $R^5$ is an alkyl group having 4 to 10 carbon atoms, more preferably an alkyl group substituted with a substituted or unsubstituted aryl group.

$X^-_p$ is a counter ion necessary to make the ionic balance in the molecule, for example, a chlorine ion, a bromine ion, an iodine ion, a sulfate ion, a p-toluenesulfonate ion and oxalate ion. $n_p$ is a number of counter ion necessary to make the ionic balance in the molecule, and $n_p$ is 0 when an intramolecular salt is formed. Concrete examples of the onium compound relating to the invention are shown below. The invention is not limited thereto.

P-1

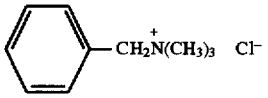

P-2

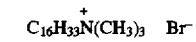

P-3

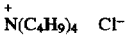

P-4

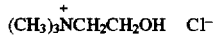

P-5

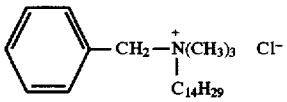

P-6

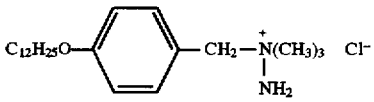

P-7

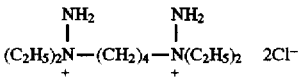

P-8

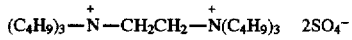

P-9

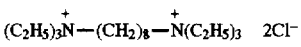

P-10

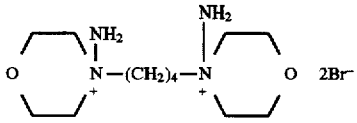

P-11

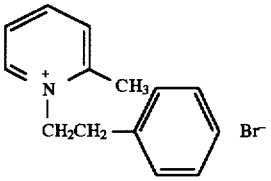

P-12

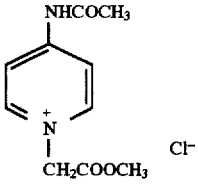

P-13

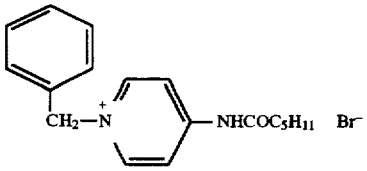

P-14

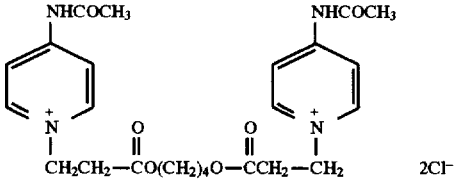

-continued
P-15
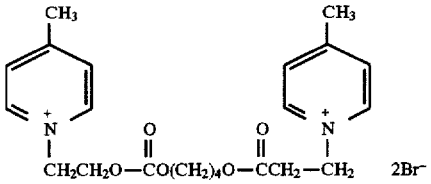
P-16
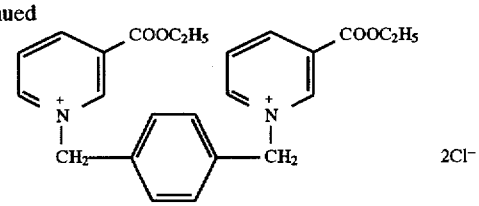
P-17
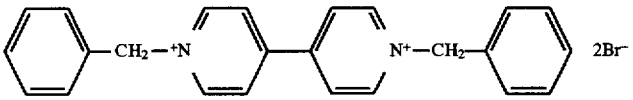
P-18
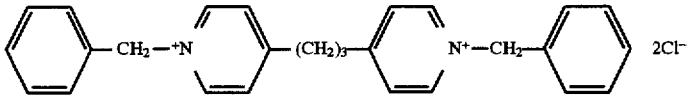
P-19
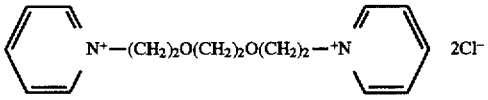
P-20
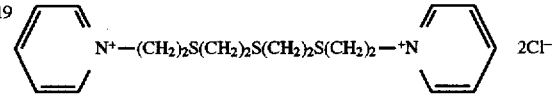
P-21
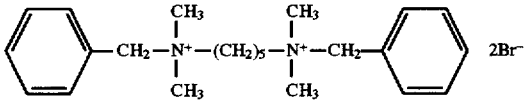
P-22
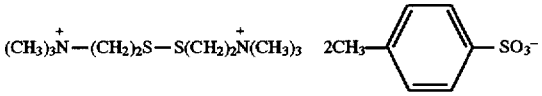
P-23
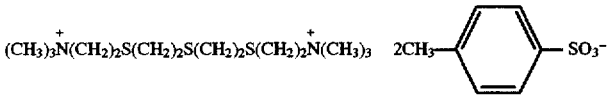
P-24
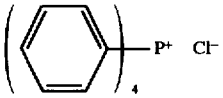
P-25
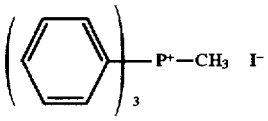
P-26
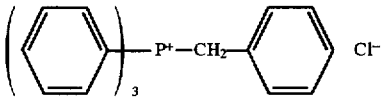
P-27
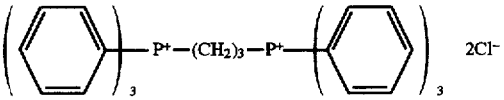
P-28
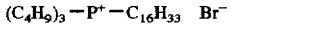
P-29
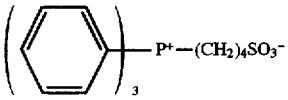
P-30
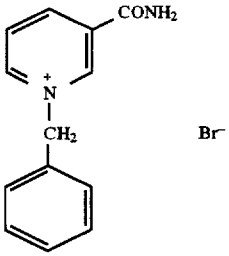
P-31
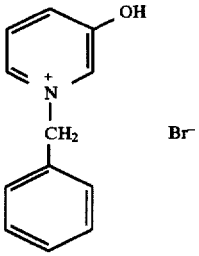
P-32
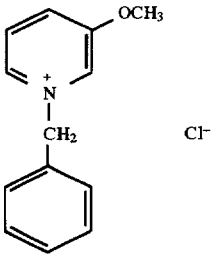
P-33
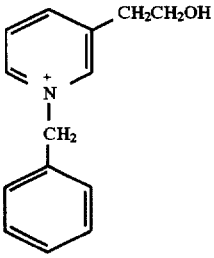

-continued
P-34
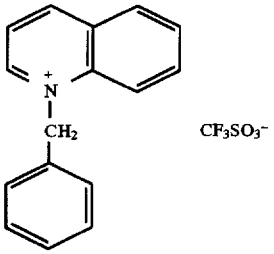
P-35
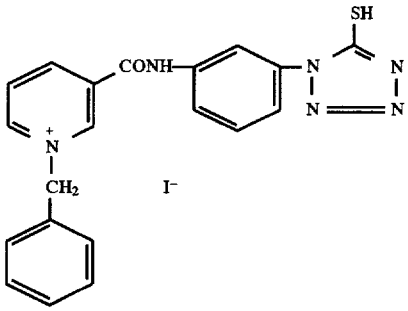
P-36
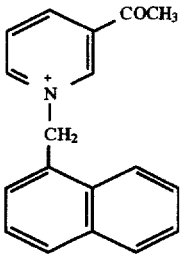
P-37
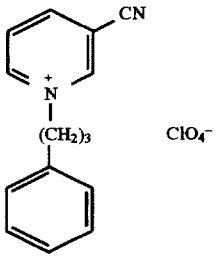
P-38
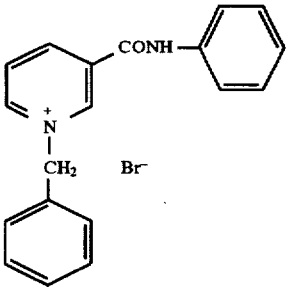
P-39
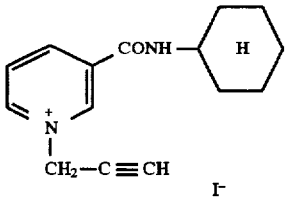
P-40
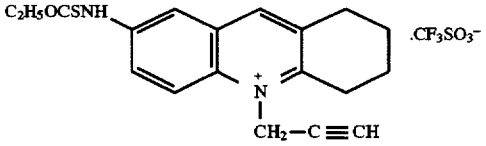
P-41
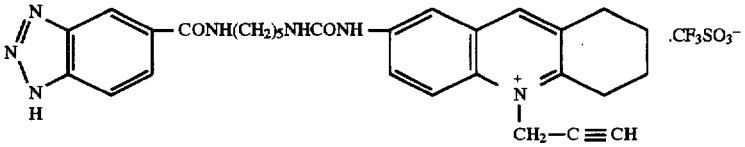
P-42
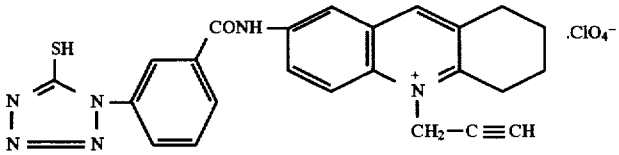
P-43
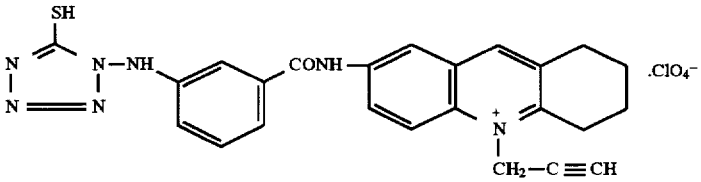

-continued
P-44
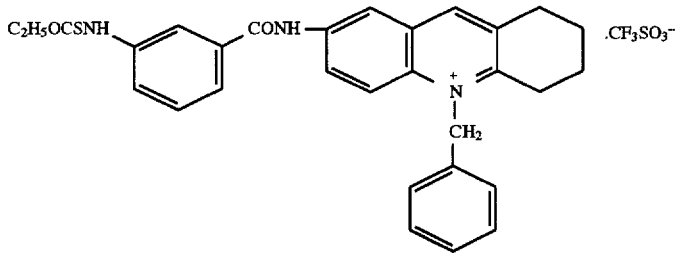
P-45
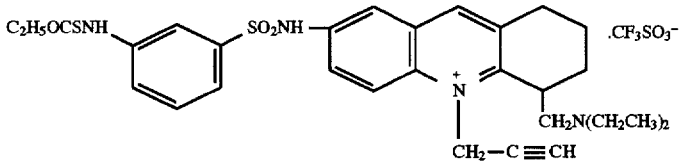
P-46
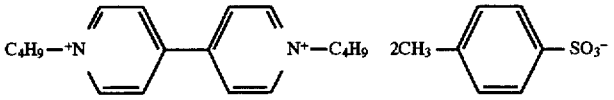
P-47
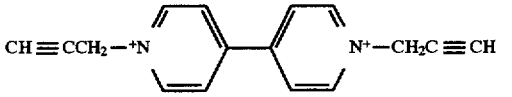
P-48
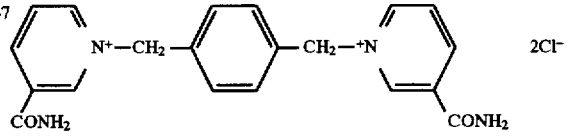
P-49
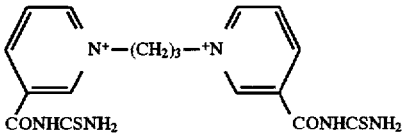
P-50
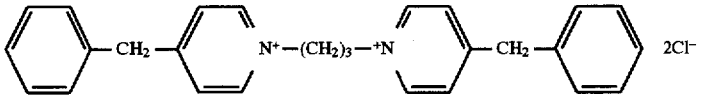
P-51
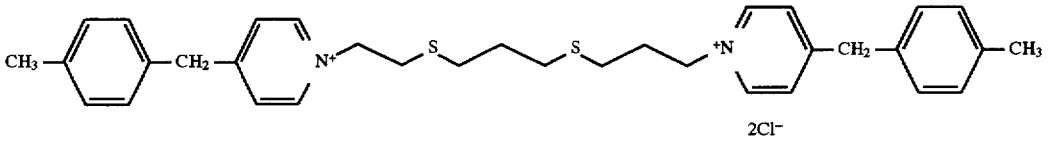
P-52
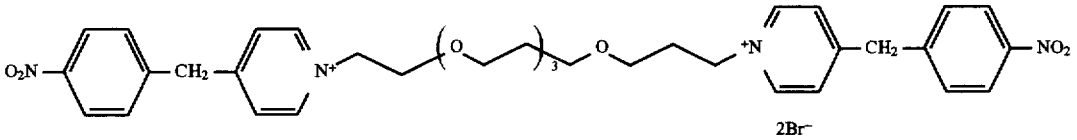
P-53
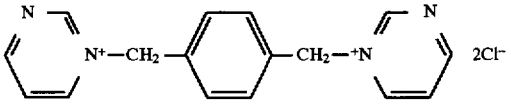
P-54
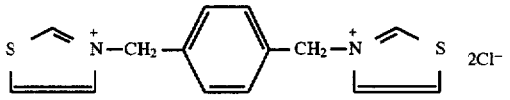
P-55
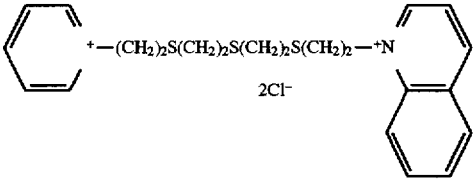

-continued

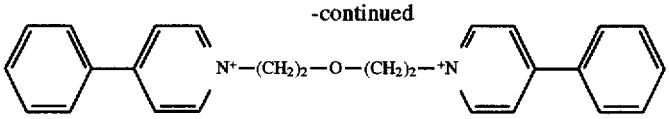

P-56

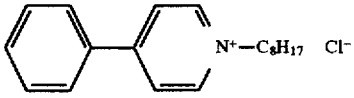

P-57

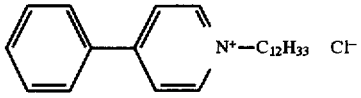

P-58

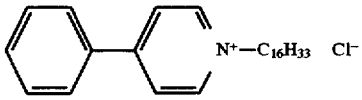

P-59

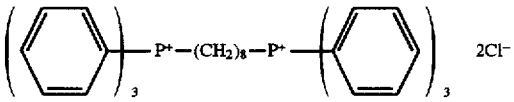

P-60

The amine compound usable in the invention is preferably one represented by the following Formula Na.

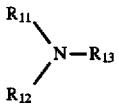

Formula Na

In Formula Na, $R_{11}$, $R_{12}$ and $R_{13}$ are each a hydrogen atom, an alkyl group, a substituted alkyl group, an alkenyl group, a substituted alkenyl group, an alkynyl group, an aryl group or a substituted aryl group. $R_{11}$, $R_{12}$ and $R_{13}$ may form a ring. The substituent of the alkyl substituted group, substituted alkenyl group and an substituted aryl group includes a hydroxyl group, an alkoxy group, an aryloxy group, a carboxyl group, w sulfo group, an alkyl group, an aryl group, a heterocyclic group, a mercapto group, a thioether group, a thione group and a thiourea group. Among the compound represented by Formula Na, an aliphatic tertiary amine compound is particularly preferred. It is preferable that the compound has a anti-diffusion group or a group accelerating adsorption to silver halide in the molecule thereof. The compounds having a molecular weight of not less than 100, more preferably not less than 300, are preferred to possess an anti-diffusion property. The adsorption acceleration group is preferably a heterocyclic group, a mercapto group, a thioether group, a thione group or a thiourea group. Particular preferable compound of Formula Na is a compound having at least one thioether group as the group accelerating adsorption to silver halide in the molecule thereof.

Concrete examples of the nucleation accelerating agent represented by Formula Na are shown below.

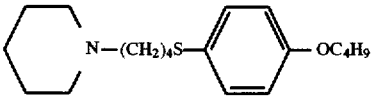

Na-1

$[(C_3H_7)_2N(CH_2)_3OCH_2CH_2]_2S$ Na-2

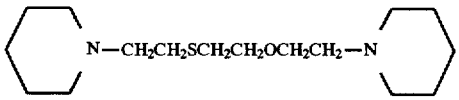

Na-3

-continued

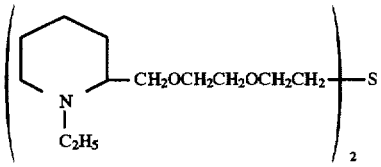

Na-4

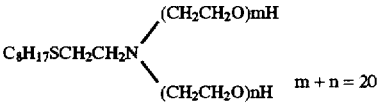

Na-5

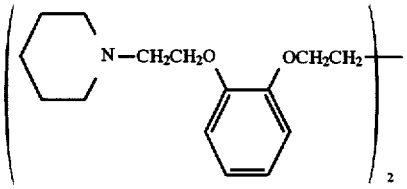

Na-6

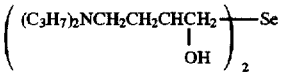

Na-7

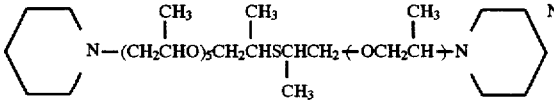

Na-8

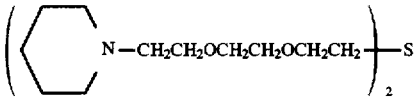

Na-9

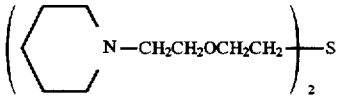

Na-10

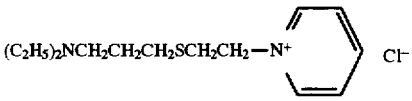

Na-11

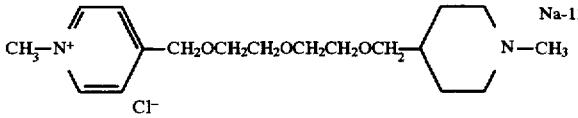

Na-12

-continued

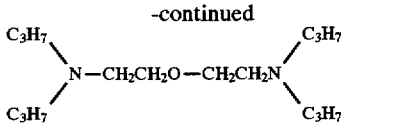
Na-13

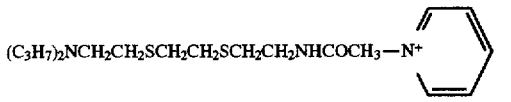
Na-14

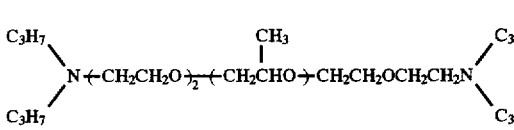
Na-15

$((C_2H_5)_2N(CH_2)_3NHCOCH_2)_2Se$ Na-16

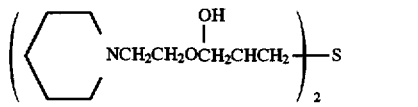
Na-17

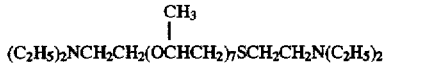
Na-18

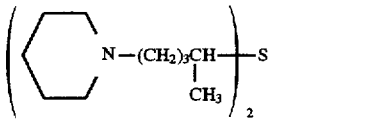
Na-19

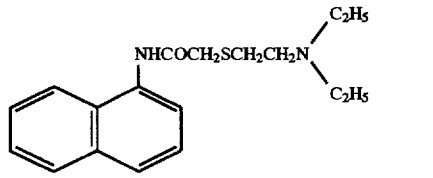
Na-20

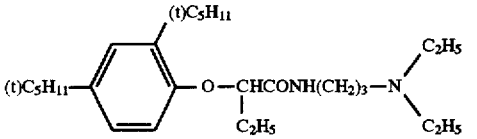
Na-21

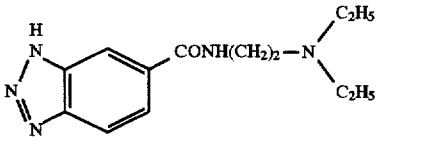
Na-22

In the invention, the light-sensitive material has at least one light-sensitive silver halide emulsion layer provided on a support and at least two non-light-sensitive hydrophilic colloid layer provided on the silver halide emulsion layer.

In the invention, the non-light-sensitive hydrophilic colloid layer may comprises a protein such as gelatin, a gelatin derivative, a graft-polymer of gelatin and a macromolecule substance other than gelatin, albumin or casein; a cellulose derivative such as hydroxyethyl cellulose, carboxymethyl cellulose or cellulose sulfate; a sugar derivative such as sodium alginate or a starch derivative; various kinds of hydrophilic homo- or co-polymer such as a polyvinyl alcohol, a partially acetalized polyvinyl alcohol, a poly-N-vinylpyrrolidone, polyacrylic acid, polymethacrylic acid, polyacrylamide, polyvinylimidazole or polyvinylpyrazole, as a hydrophilic colloid. The non-light-sensitive hydrophilic colloid layer may contains a non-light-sensitive silver halide emulsion.

It is preferred that the light-sensitive material has at least two silver halide emulsion layers for enhancing the effect of the invention. The sensitivities of these emulsion layers may be the same or different. These emulsion layers may be adjacent or have an interlayer of non-light-sensitive hydrophilic colloid between them.

In the black-and-white silver halide light-sensitive material of the invention, the dry layer thickness of layers provided on the silver halide emulsion layer arranged nearest to the support, i.e., the distance from the outermost surface of the emulsion coated side to the surface farther from the support of the emulsion layer arranged nearest to the support is 2.5 to 8 μm, more preferably 3 to 5 μg. The layer thickness can be determined by electron microscopic observation of the light-sensitive material sliced under a dry condition. The total thickness of the layers provided on the silver halide emulsion layer nearest to the support is preferably 2 to 12 times, more preferably 4 to 10 times of the thickness of the layer arranged at the outermost portion of the layers.

The light-sensitive material of the invention preferably composed of a support, two silver halide emulsion layers provided on the support so as to adjoin with each other and two non-light-sensitive hydrophilic colloid layers arranged on the silver halide emulsion layers. In such the case, it is preferable that the sensitivity of the first silver halide emulsion layer arranged nearly to the suppor is higher than that of the second emulsion layer arranged farther from the support than the first emulsion layer.

When the layer thickness is within the range of from 2.5 μm to 8 μm, a satisfactory reproducibility of white letter on halftone background cannbe obtained The silver halide grains of the silver halide emulsion usable in the silver halide emulsion layer of the invention have a silver chloride content of from 90 mole-% to 100 mole-%. A silver halide emulsion comprised of silver chlorobromide or silver chloroiodobromide each having a silver chloride content of not less than 90 mole-% or silver chloride are preferably used.

The average grain diameter of the silver halide grains is preferably not more than 0.6 μm, particularly preferably 0.5 to 0.05 μm. The average diameter is a term commonly used in the field of the art and easily be understood by skilled one. The "grain diameter" means the diameter of a grain when the grain has a spherical shape or a shape which can be approximated to a sphere. When the grain has a cubic shape, the cube is converted to a sphere having the same volume as the cube and the diameter of the sphere is determined as the grain diameter. Regarding the detail of the method for measuring the grain diameter, C. E. Mees & T. H. James, "The Theory of the Photographic Process, Ed. 3, p.p. 36 to 43, Mcmillan Press, 1966, can be referred.

The silver halide grain may have any shape such as tabular, spherical, cubic, tetradecahedral and regular octahedral without any limitation. The size distribution of the grains is preferably to be narrow and a monodisperse emulsion is preferred, in which 90%, preferably 95%, of the whole number of silver halide grain is included within the range of ±40% of the average grain diameter.

Among the above tabular grains, tabular grains having (100) plane as the major face may be used, which is described in U.S. Pat. Nos. 5,264,337, 5,314,798 and 5,320,958 and is easily prepared according to the description.

Any of a single-jet mixing method, a double-jet mixing method and the combination thereof may be usable for reacting a soluble silver salt and a soluble halide salt. A method by which silver halide grains are formed in the presence of excess silver ions, so-called reverse mixing method, is also may be used. As a form of the double-jet mixing, a method by which the pAg value in the liquid phase, in which silver halide grains are formed, is maintained at a constant level, so-called a controlled double-jet method, can be used. A silver halide emulsion composed of grains having a regular shape and a size distribution approximately uniform can be prepared by this method.

In the invention, silver halide grains contain at least one kind of metal selected from the metals of Group VIII of the periodic table and rhenium. As the metals of Group VIII, iridium, rhodium, ruthenium and Osmium, preferably ruthenium and/or Osmium, are cited. The metal is preferably added in an amount of $10^{-9}$ moles to $10^{-3}$ moles per mole of silver halide.

A compound of halogen, carbonyl, nitrosyl, thionitrosyl, amine, cyan, thiocyan, ammonia, tellurocyan, selenocyan, dipyridyl, tripyridyl or phenanthroline or combination thereof may be coordinated with the metal when the metal compound is added to the silver halide grains. The oxidation state of the metal can be optionally selected from the highest oxidation level to the lowest oxidation level. The preferable ligand includes a hexadentate ligand described in JP O.P.I. Nos. 2-20852/1990, 2-20853/1990, 2-20854/1990 and 2-20855/1990, an alkali complex such as an ordinary sodium salt, potassium salt and cesium salt, and a primary, secondary or tertiary amine salt. The transition metal complex in a form of core-complex may be formed. The examples of the complex include $K_2[RuCl_6]$, $(NH_4)_2[RuCl_6]$, $K_2[Ru(NO)Cl_4(CNS)]$ and $K_2[RuCl_5(H_2O)]$. The examples further include ones in which Ru in the above complexes is replaced by Re, Rh, Os or Ir.

Although the metal complex may be added at an optional step between the formation of silver halide grains and the coating, and it is preferred to add the complex during the period of grain formation, physical ripening and/or chemical ripening. It is more preferred to added during the period of formation of silver halide grains. The metal complex may be distributed uniformly in a grain or localized in a silver halide grain having a core/shell structure so that a larger amount of the metal complex is contained in the core portion compared to the shell portion.

Further, a salt of another metal such as zinc, lead, thallium, palladium or platinum may be co-existed with the silver halide agrains at the period of physical or chemical ripening.

The silver halide emulsion and the preparation method thereof are described in detail in Research Disclosure, No. 176, 17643, p.p. 22 to 23 (December 1978) and documents cited therein.

It is preferred that the silver halide emulsion is chemically sensitized. As the method of the chemical sensitization, a sulfur sensitization, selenium sensitization, tellurium sensitization, reduction sensitization and noble metal sensitization may be applied singly or in combination. Known sulfur sensitizers may be used, and a sulfur compound contained in gelatin, and various compounds such as thiosulfates, thioureas, rhodanines and polysulfides are usable as preferable sulfur sensitizer. As the selenium sensitizer, known selenium compounds are usable, and those described in, for example, U.S. Pat. No. 1,623,499, JP O.P.I. Nos. 50-71325/1975 and 60-150046/1985 are preferably usable. As the noble metal sensitizer, a gold compound, platinum compound and palladium compound are preferably usable. The gold compound is more preferable among them.

Combinations of the chemical sensitizers includes, for example, a combination of the sulfur sensitizer and the noble metal sensitizer, a combination of the selenium sensitizer and the noble metal sensitizer and a combination of the reduction sensitizer and the noble metal sensitizer. In the invention, it is preferred to add at least one kind of gold sensitizer for the sensitization.

Although these chemical sensitizers may be added at an optional step of the preparation of silver halide emulsion, it is preferred to add the sensitizers at a time between after completion of silver halide grain formation and coating the emulsion.

The adding amount of each of the chemical sensitizers is preferably within the range of from $10^{-9}$ moles to $10^{-3}$ moles per mole of silver halide.

When the gold compound is used, the amount of the gold compound is preferably 0.1 to 1 times of that of the complex of the metal selected from the metals of Group VIII and rhenium in mole.

In the invention, at least one of the non-light-sensitive hydrophilic layers provided on the silver halide emulsion layer contains a matting agent having an average diameter of 4 to 10 μm. The matting agent may be one having a regular shape or irregular shape. The matting agent containing-layer is preferably the layer arranged at the outermost protion of the emulsion coating side of the light-sensitive material.

In the invention, known matting agents may be used. The matting agent includes, for example, particles of an inorganic substance such as silica described in Swiss Patent No. 330,158, glass powder described in French Patent No. 1,296,995, or carbonate of alkali-earth metal such as cadmium or zinc described in British Patent No. 1,173,181 and particles of an organic substance such as starch described in U.S. Pat. No. 2,322,037, a starch derivative described in Belgian Patent No. 625,451 or British Patent No. 981,198, polyvinyl alcohol described in Japanese Patent No. 44-3643/1969, polystyrene or polymethyl methacrylate described in Swiss Patent No. 330,158, polyacrylonitrile described in U.S. Pat. No. 3,079,257, or polycarbonate described in U.S. Pat. No. 3,022,169.

These matting agents may be used singly or in combination. Although the shape of the regular shaped matting agent is preferably spherical, one having another shape such as tabular or cubic may also usable. The size of the matting agent is expressed in terms of diameter of a sphere having the volume the same as the volume of the matting agent particle. In the invention, the diameter of matting agent is the diameter of the sphere converted as above.

It is preferred for attaining the basic function of the matting agent, a part of matting agent particle is exposed from the surface. The matting agent exposed from the surface may be a part of or all the matting agent added. The matting agent is previously dispersed in the coating liquid and coated.

A regular shaped and/or an irregular matting agent each having an average diameter of less than 4 μm may be used in combination.

In the invention, it is preferred that at least one layer provided on the emulsion coated side contains a dye dispersed in a form of solid particles (hereinafter referred to solid fine particle dispersion of dye). As the dye to be dispersed to the solid particles, a compound represented by Formula [I] to [VI] is preferably used.

$$A{=}L_1{\leftarrow}L_2{=}L_3{\rightarrow}_{m2}Q \qquad \text{Formula [I]}$$

-continued $$A{=}L_1{+}L_2{=}L_3{\rightarrow}_t A' \quad \text{Formula [II]}$$

$$A{\leftarrow}L_1{-}L_2{\rightarrow}_{p2}B \quad \text{Formula [III]}$$

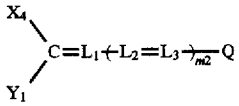

Formula [IV]

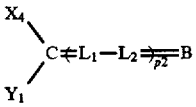

Formula [V]

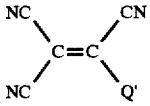

Formula [VI]

In the formula, A and A' are each an acidic nucleus which may be the same or different, and B is a basic nucleus, Q' is a heterocyclic group, $X_4$ and $Y_1$ are each an electron withdrawing group which may be the same or different, and $L_1$, $L_2$ and $L_3$ are each a methine group. $m_2$ is 0 or 1, t is 0, 1 or 2, and $P_2$ is 0 or 1. The dyes represented by [I] to [VI] each have at least one group selected from a carboxyl group, sulfonamide group and a sulfamoyl group in the molecular thereof.

As the acidic nucleus represented by A or A' in Formulas [I], [II] and [III], a nucleus of 5-pyrazolone, barbituric acid, thiobarbituric acid, rhodanine, hydantoin, thiohydantoin, oxazolone, isooxazolone, indandione, pyrazolidinedione, oxazolinedione, hydroxypyridone and pyrazolipyridone are preferably cited.

As the basic nucleus represented by B in Formulas [III] and [V], a nucleus of pyridine, quinoline, benzoxazole, naphthoxazole, thiazole, benzothiazole, naphthothiazole, indolenine, pyrrole and indole are preferably cited.

As the aryl group represented by Q in Formulas [I] and [IV], a phenyl group and a naphthyl group are cited. The heterocyclic group represented by Q or Q' in Formula [I], [IV] and [VI] include, for example, a pyridyl group, a quinolyl group, an isoquinolyl group, a pyrrolyl group, a pyrazolyl group, an imidazolyl group, an indolyl group, a furyl group and a thienyl group. The aryl group and the heterocyclic group include ones having a substituent. As the substituent, an alkyl group having 1 to 8 carbon atoms such as a methyl group, ethyl group, t-butyl group, octyl group, 2-hydroxyethyl group and 2-methoxyethyl group, a hydroxy group, a cyano group, a halogen atom such as a fluorine atom and chlorine atom, an alkoxy group having 1 to 6 carbon atoms such as a methoxy group, ethoxy group, 2-hydroxyethoxy group, methylenedioxy group and butoxy group, a substituted amino group such as a dimethylamino group, diethylamino group, di(n-butyl)amino group, N-ethyl-N-hydroxyethylamino group, N-ethyl-N-methanesulfonamidoethylamino group, morpholino group, piperidino group and pyrrolidino group, a carboxyl group, a sulfonamido group such as a methanesulfonamido group and benzenesulfonamido group and a sulfamoyl group such as a sulfamoyl group, methylsulfamoyl group and phenylsulfamoyl group are preferred, these substituents may be applied in combination.

The electron withdrawing groups represented by $X_4$ and $Y_1$ in Formula [IV] and [V] may be the same or different and ones having a Hammett's substituent constant σp, described in "Relation of Structural Activity of Medicine" Extra Number 122 of Kagaku no Ryoiki edited by Fujita, p.p. 96–103, 1979, of not less than 3.0 are preferred, which include, for example, a cyano group, an alkoxycarbonyl group such as a methoxycarbonyl group, ethoxycarbonyl group, butoxycarbonyl group and octyloxycarbonyl group, an aryloxycarbonyl group such as a phenoxycarbonyl group and 4-hydroxyphenoxycarbonyl group, a carbamoyl group such as a carbamoyl group, dimethylcarbamoyl group, phenylcarbamoyl group and 4-carboxyphenylcarbamoyl group, an acyl group such as a methylcarbonyl group, ethylcarbonyl group, butylcarbonyl group, phenylcarbonyl group and 4-ethylsulfonamidocarbonyl group, an alkylsulfonyl group such as a methylsulfonyl group, ethylsulfonyl group, butylsulfonyl group and octylsulfonyl group and an arylsulfonyl group such as a phenylsulfonyl group and 4-chlorophenylsulfonyl group.

The methine group represented by $L_1$, $L_2$ and $L_3$ on Formulas [I] to [V] include ones having a substituent. As the substituent, for example, an alkyl group having 1 to 6 carbon atoms such as a methyl group, ethyl group and hexyl group, an aryl group such as a phenyl group, tolyl group and 4-hydroxyphenyl group, an aralkyl group such as a benzyl group and phenetyl group, a heterocyclic group such as a pyridyl group, furyl group and thienyl group, a substituted amino group such as a dimethylamino group, diethylamino group and anilino group and an alkylthio group such as a methylthio group are cited.

In the invention, among the dyes represented by Formula [I] to [VI], ones having at least one carboxyl group in the molecule thereof are preferable, and dyes represented by Formula [I] is more preferred and ones represented by Formula [I] in which Q is a furyl group are particularly preferred.

Although concrete examples of preferably usable dye are shown below, the dye is not limited thereto.

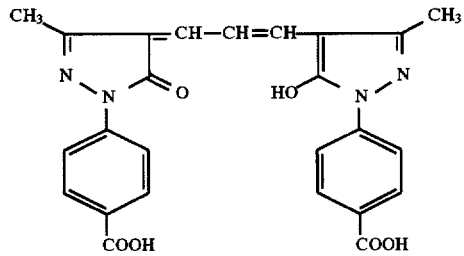

AD-1

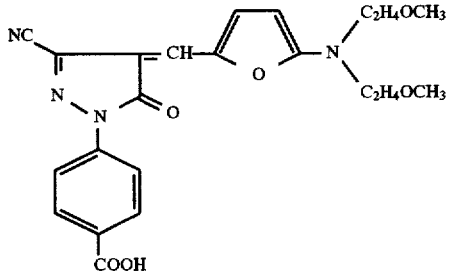

AD-2

-continued

AD-3

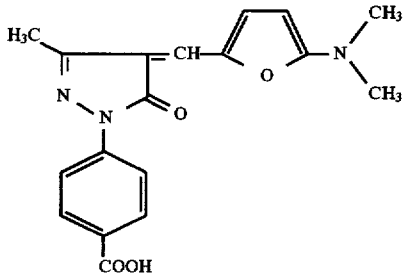

AD-4

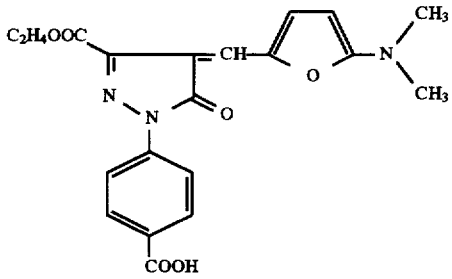

AD-5

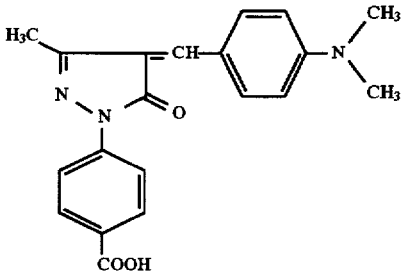

AD-6

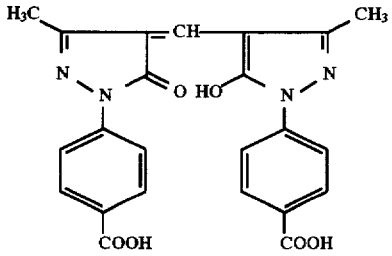

AD-7

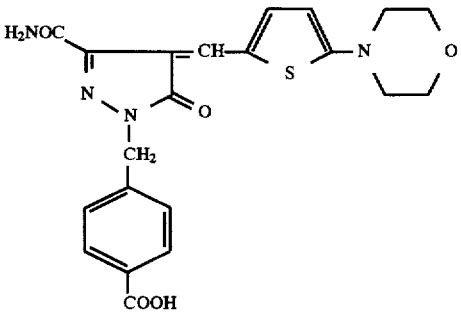

-continued

AD-8

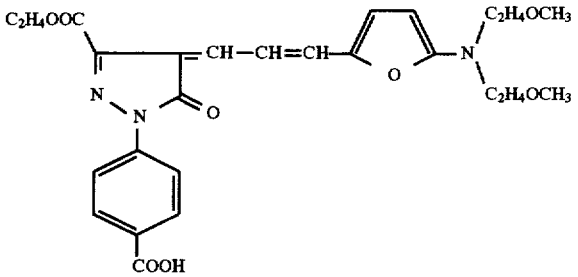

AD-9

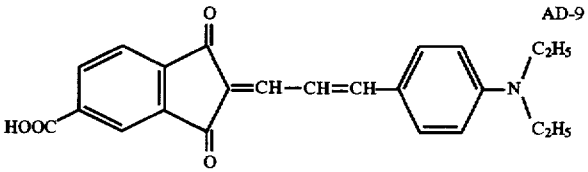

AD-10

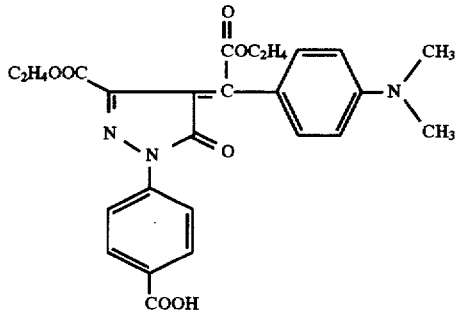

AD-11

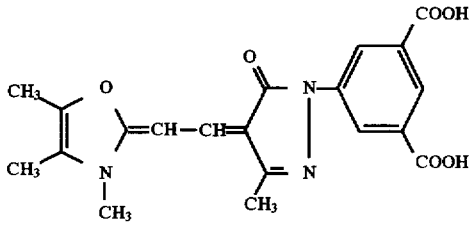

AD-12

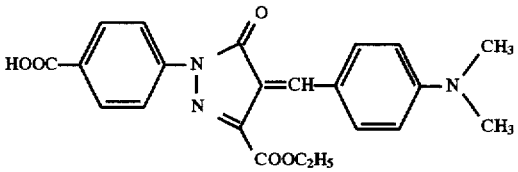

As preferable examples of the compound represented by Formula [I] to [VI] other than the above-mentioned, for example, Compound Nos. 1-1 to I-30, II-1 to II-12, III-1 to III-8, IV-1 to IV-9, V-1 to V-8 and VI-1 to VI-5 described in JP O.P.I. No. 7-128793 are cited. However the dye is not limited thereto.

The methods described in JP O.P.I. Nos. 52-92716, 55155350, 55-155351, 63-197943 and 3-182743 and W088/04794 can be applied to prepare the dispersion of solid particle of dye relating to the invention. In concrete, the dispersion can be prepared by means of a fine dispersing machine such as a ball mill, planet mill, vibration mill, sand mill, roller mill, a jet mill and disk impeller mill.

Furthermore, the dispersion of the compound can be prepared by a method by which the compound is dissolved in weak alkaline water and then the pH of the solution is lowered to a weak acidity to precipitate the compound in a form of fine solid particles or a method by which an weak alkaline solution of the compound and an acidic water are mixed by a double-jet method to precipitate fine solid particles of the compound, when the compound to be dispersed to solid particles is water-insoluble at a relative low pH and water-soluble at a relative high pH. The dispersion of solid particle of the dye may be use singly or in combination of two or more kinds. The dispersion may be used as a mixture of a dispersion of compound other than that of the invention. When two or more kinds of compounds are used in combination, the compounds may be mixed after dispersed separately or may be dispersed simultaneously.

It is preferred to exist a surfactant during or after dispersing process when the dispersion of solid particles of dye is prepared in the presence of an aqueous medium. Although an anionic surfactant, a nonionic surfactant, a cationic surfactant and an amphoteric surfactant may also be used as the surfactant, an anionic surfactant such as alkylsulfonates, alkylbenzenesulfonates, alkylnaphthalenesulfonates, alkyl sulfates, sulfosuccinates, sulfoalkylpolyoxyethylene-alkylphenyl ethers and N-acyl-N-alkyltaulines, and a nonionic surfactant such as saponine, alkyleneoxide derivatives and alkyl esters of sugar, are preferred. The above-mentioned anionic surfactants are particularly preferred. As concrete examples of the surfactant, Compounds 1 to 32 described on page 32 to 46 of Japanese Patent Application 5277011 are cited, the surfactant is not limited thereto.

The using amount of the anionic and/or nonionic surfactant is usually 0.1 mg to 2000 mg, preferably 0.5 mg to 1000 mg, per gram of the dye even though the amount is varied depending on the kind of surfactant or the dispersing condition of the dispersing liquid medium. The concentration of the dye in the dispersion is 0.01% to 10%, preferably 0.1% to 5%, by weight. The surfactant is preferably added at a step before the start of dispersion, and may be further added after completion of the dispersion according to necessity. The anionic and/or nonionic surfactant may be used singly or in combination of two or more kinds including a combination of both of the anionic and nonionic ones.

The solid particle dispersion of the dye is preferably dispersed so that the average diameter is 0.01 μm to 5 μm, more preferably 0.01 μm to 1 μm, particularly preferably 0.01 μm to 0.5 μm. The variation coefficient of the particle size distribution of the dispersed solid particles is preferably not more than 50%, more preferably not more than 40%, further preferably not more than 30%. The variation coefficient of the particle size distribution is a value determined by the following equation.

(Standard deviation of particle diameter)/(Average of particle diameter)×100

A hydrophilic colloid to be used as the binder of a photographic constituent layer may be added to the solid particle dispersion of the invention before the start or after completion of dispersing process. Although gelatin is advantageously used as the hydrophilic colloid, another hydrophilic colloid, for example, a gelatin derivative such as phenylcarbamyl gelatin, acylated gelatin and phthalated gelatin, a graft-polymer of gelatin and a monomer having a methylene group capable of polymerizing with gelatin, a cellulose derivative such as carboxymethyl cellulose, hyedroxymethyl cellulose and cellulose sulfate, a hydrophilic polymer such as polyvinyl alcohol, partially oxide polyvinyl acetate, polyacrylamide, poly-N-,N-dimethylacrylamide, poly-N-vinylpyrrolidone and polymethacrylic acid, agar, gum arabic, algic acid, albumin and casein are also usable. Two or more kinds of the hydrophilic colloid ma be used in combination. The adding hydrophilic colloid to be added to the solid particle dispersion is preferably 0.1% to 12%, more preferably 0.5% to 8%, by weight.

The solid particle dispersion of the dye is preferably added to a layer constituting the photographic material such as a light-sensitive emulsion layer, upper emulsion layer, lower emulsion layer, protective layer, subbing layer of the support or backing layer. It is particularly preferred for enhancing the antihalation effect to add the dispersion into a layer provided between the support and the emulsion layer or a constituent layer provided on the side of the support opposite to the emulsion coated side. For enhancing the effect on the resistivity against safelight, the solid particle dispersion is preferably added to a layer provided on the emulsion layer.

The preferable adding amount of the solid particle dispersion of the dye is 1 mg to 1 g, preferably 5 to 800 mg, more preferably 10 mg to 500 mg, per square meter of the light-sensitive material, which may be varied depending on the kind of th dye or the property of the photographic light-sensitive material.

In the coating and dying process of the light-sensitive material, a coating liquid which is a composition containing a hydrophilic colloid such as gelatin as a binder, is coated on a support and is chilled and set in cold air usually having a dry bulb temperature of −10° C. to 15° C., then the temperature is raised for removing the moisture in the coated layer by evaporation. The ratio of water to gelatin is usually about 2000% at the time just after the coating.

It is preferred for inhibiting submergence of matting agent during the coating and drying process to provide at least two hydrophilic colloid layers on the silver halide emulsion layer, in which the gelatin concentration of the lower hydrophilic layer adjoining with the uppermost layer is preferably not less than 3.0% and the gelatin concentration in the lower hydrophilic colloid layer preferably higher not less than 0.5%, more preferably 1.0%, than that of the uppermost hydrophilic layer in which the matting agent is contained. It is also preferred that the wet bulb temperature of the coated surface is not more than 20° C., more preferably 4° to 19° C., when the weight ratio of water to binder is 200% or more.

It is preferred that at least one kind of hydrazine derivative is contained in the emulsion layer in which the ratio of silver weight/gelatin weight is highest when a plurality of silver halide emulsion layers are provided. In the layer having the highest weight ratio of silver/gelatin, the weight of silver is preferably 1.5 to 10 times of that of gelatin. It is preferred that the layer having the highest weight ratio of silver/gelatin is the emulsion layer provided at the position nearest to the support.

Various compounds may be contained in the light-sensitive material of the invention for the purpose of inhibiting fog occurred during the production process, storage and photographic processing of the light-sensitive material or stabilizing the photographic properties of the light-sensitive material. Various kinds of compound know as a fog inhibitor or stabilizer may be added in the silver halide emulsion layer or the hydrophilic colloid layer, which include azoles such as benzothiazolium salts, nitroindazoles, nitrobenzimidazoles, cholorobenzimidazoles, bromobenzimidazoles, mercaptothiazoles, mercatobenzothiazoles, mercaptobenzimidazoles, mercaptothiadiazoles, aminotriazoles, benzotriazoles, nitrobenzotriazoles and mercaptotetrazoles (particularly 1-phenyl-5-mercaptotetrazole); mercaptopyrimidines, mercaptotriazines; thioketo compounds such as oxazolinethiones; azaindenes such as triazaindenes, tetraazaindenes (particularly 4-hydroxy-substituted 1,3,3a,7-tetrazaindenes), pentaazaindenes; benzenethiosulfonic acid, benzenesulfinic acid and benzenesulfonamide.

Although it is advantageous to use gelatin as the binder or protective colloid of the photographic emulsion, another hydrophilic colloid may be used. Various hydrophilic colloids may be used, which include, for example, proteins such as a gelatin derivative, a graft-polymer of gelatin and another polymer, albumin and casein, a cellulose derivative such as hydroxyethyl cellulose, carboxymethyl cellulose and cellulose sulfate, a sugar derivative such as sodium arginate and a starch derivative, a various kinds of synthesized hydrophilic macromolecular substance such as a homo- or co-polymer, for example, polyvinyl alcohol, partially acetarized polyvinyl alcohol, poly-N-vinylpyrrolidone, polyacrylic acid, polymethacrylic acid, polyacrylamide, polyvinylimidazole and polyvinylpyrazole.

As the gelatin, acid processed gelatin, hydrolized gelatin and enzyme processed gelatin may be used as well as lime-processed gelatin.

As a means for realizing a rapid processing, it is preferred that the adding amount of gelatin provided on the emulsion coated side is 0.5 to 2.7 g per square meter in total and that on the side opposite to the emulsion coated side is 0.5 to 2.9 g per square meter in total.

In the emulsion of the invention, a dispersion of water-insoluble or slightly soluble synthetic polymer may be incorporated for the purpose of improvement of dimension stability. As the polymer, for example, a homo- or copolymer derived from the monomer of an alkyl acrylate, an alkyl methacrylate, an alkoxyalkyl acrylate, an alkoxyalkyl methacrylate, a glycidyl acrylate, a glycidyl methacrylate, an acrylamide, a methacrylamide, a vinyl ester such as vinyl acetate, acrylonitrile, an olefin and styrene, and a copolymer formed from a combination of the above-mentioned monomer and acrylic acid, methacrylic acid, α,β-unsaturated dicarboxylic acid, a hydroxyalkyl acrylate, a hydroxyalkyl methacrylate, a sulfoalkyl acrylate, sulfoalkyl methacrylate or a styrenesulfonic acid may be used as the above-mentioned polymer.

It is preferable that a hydrophilic colloid is contained in at least one of constituent layers of the light-sensitive material. The preferable hydrophilic polymer includes starch, glucose, dextrin, dextran, cyclodextrine, saccharose, maltose, xanthane gum and carrageenin. The molecular weight of the hydrophilic polymer is preferably within the range of 600 to 10,00,000. Although a lower molecular weight is advantageous for rapidly dissolving out from the layer to the processing solution during the processing, the molecular weight excessively low causes degradation of the layer strength of the film. Therefore, a molecular weight of not less than 400 is preferred. It is preferable to add inorganic silica, colloidal tin, colloidal zinc, colloidal titanium, colloidal yttrium, colloidal praseodymium, colloidal neodymium, zeolite and apatite since the scratch resistivity of the film is degraded when the hydrophilic polymer is used. Zeolite includes anacite, erionite, mordenite, shabacite, gmelinite and levynite, and synthetic zeolite includes zeolite A, X, Y and L. Apatite includes hydroxy apatite, fluorinated apatite and chlorinated apatite. The preferable adding amount is 1% to 200% by weight of the hydrophilic binder. The above-mentioned inorganic compound may be treated by a silane coupling agent to inhibit coagulation in the emulsion and to stabilize the coating liquid. Cracks of the coated layer caused by the inorganic compound can also be prevented. As the silane coupling agent, triethoxysilano-vinyl, trimethoxysilanovinyl, trimethoxy-silanepropyl methacrylate, trimethoxysilanopropylglycidyl, 1-mercapto-3-triethoxysilanopropane, 1-amino-3-triethoxysilanopropane, triethoxysilanophenyl and triethoxymetylsilane are cited. The effect of the silane coupling agent can be enhanced by treating with the inorganic compound at a high temperature compared to the treatment by simply mixing. The mixing ratio is preferably selected within the range of 1:100 to 100:1.

In the invention, it is preferred that the light-sensitive material has at least one hydrophilic colloid layer on the side of the support opposite to the emulsion coated side and at least one hydrophobic polymer layer provided on the hydrophilic layer. The hydrophilic colloid layer includes a layer so-called backing layer. In the invention, the constitution is preferred in which at least one hydrophobic polymer layer is provided on the outer surface of the backing layer. The hydrophobic layer is a layer comprising a hydrophobic polymer as a binder. Concrete example of the binder of the polymer layer includes a polyethylene, polypropylene, polystyrene, polyvinyl chloride, polyvinylidene chloride, polyacrylonitrile, polyvinyl acetate, urethane resin, urea resin, melamine resin, phenol resin, epoxy resin, fluororesin such as polytetrafluoroethylene and polyvinylidene fluoride, rubber such as butadiene rubber, chloroplene rubber and natural rubber, ester of acrylic acid or methacrylic acid such as polymethyl methacrylate and polyethyl acrylate, polyester resin such as polyethylene terephthalate, polyamide resin such as Nylon 6 and Nylon 66, cellulose resin such as cellulose triacetate and water-insoluble polymer such as silicone resin and derivatives of the above polymers. The binder of the polymer layer may be a homopolymer composed of one kind of monomer or a copolymer composed of two or more kinds of monomer. Particularly preferred polymers are a copolymer of an alkyl acrylate or an alkyl methacrylate and acrylic acid or methacrylic acid, preferably one having a content of acrylic acid or methacrylic acid of not more than 5%, styrene-butadiene copolymer, styrene-butadiene-acrylic acid copolymer, preferably one having an acrylic acid content of not more than 5%, styrene-butadiene-divinylbenzenemethacrylic acid copolymer preferably one having a methacrylic acid content of not more than 5%, vinyl acetate-ethyleneacrylic acid copolymer preferably one having an acrylic acid content of not more than 5%, vinylidene chlorideacrylonitrile-methyl methacrylate-ethyl acrylate-acrylic acid copolymer preferably one having an acrylic acid content of not more than 5%, and ethyl acrylate-glycidyl methacrylate-acrylic acid copolymer. These polymer may be used singly or in combination.

In the hydrophobic polymer layer, a photographic additive such as a matting agent, a surfactant, a dye, a lubricant, a cross-linking agent, a thickener, a UV absorbent and an inorganic particle such as colloidal silica may be added. Regarding these additives, description in Research Disclosure No. 176, 17646, (December 1978) may be referred.

In the invention, the number of the polymer layer may be one or two or more. There is no limitation on the thickness of the polymer layer. However, the polymer layer having a thickness too thin is not suitable since the resistivity against water of the polymer layer is made insufficient and the backing layer is swollen by the processing solution. Contrary to that, when the thickness of the polymer layer is too thick, the moisture permeability of the polymer layer is become insufficient. As a result, the moisture absorption-desorption of the backing hydrophilic colloid layer is inhibited and curling of the film is occurred. Of course, the thickness of the hydrophobic polymer layer depends on the physical property of the binder. Accordingly, the thickness of the polymer layer is to be decided with consideration on both of the above mentioned factors. The thickness of the hydrophobic polymer layer is preferably 0.05 to 10 μm, more preferably 0.1 to 5 μm, even though the thickness may be varied according to the kind of binder. In the invention, the thickness of the hydrophobic polymer layer of the silver halide photographic light-sensitive material is the total of the thickness of the hydrophobic polymer layers when the number of hydrophobic polymer layer is two or more.

There is no limitation on the method for coating the hydrophobic polymer layer in the invention. The polymer layer may be coated and dried on the backing layer previously coated and dried or may be simultaneously coated together with the backing layer and dried. The hydrophobic polymer layer may be coated by a solvent solution composed of the polymer dissolved in a solvent or by a aqueous system using an aqueous dispersion of the polymer.

The black-and-white silver halide photographic light-sensitive material of the invention preferably has at least one antistatic layer on the side opposite to the emulsion coated side. The light-sensitive material preferably has an adhesive layer/an antistatic layer/a backing layer containing the hydrophilic colloid/a hydrophobic colloid layer in this order on the support thereof. A protective layer may be provided on the above-mentioned layer. The adhesive layer may be prepared by coating, on a support previously treated by corona discharge, a layer of a vinylidene chloride copolymer or a styrene-glycidyl acrylate copolymer of 0.1 to 1 μm and a gelatin layer containing fine particles of tin oxide or vanadium pentaoxide having an average diameter of 0.01 μm to 1 μm on the polymer layer. The adhesive layer may also be prepared by coating styrenesulfonic acid-maleic acid copolymer cross-linked by a cross-linking agent such as epoxy compounds, azilidine compounds or carbonyl reactive type compounds. A dyed backing layer may be provided on the antistatic layer. The antistatic layer is preferably prepared by the method described in JP 8-15811/1996 [0046]–[0048].

In the above-mentioned layers, an inorganic filler such as colloidal silica for raising the dimension stability, a matting agent of silica or methyl methacrylate, a silicone lubricant or releasing agent for controlling the transportability may be contained. The backing layer may contains a backing dye. A benzilidene dye and an oxonol dye are preferably used as the backing dye. These alkali-soluble or alkali-decomposable dye may be fixed in the backing layer by making in a form of fine powder. The optical density of the dye for antihalation is preferably 0.1 to 2.0 at the sensitive wavelength.

In the photographic emulsion layer and non-light-sensitive hydrophilic colloid layer of the invention, an inorganic or organic hardener is preferably added as a cross-linking agent for the hydrophilic colloid such as gelatin. The following hardener may be used singly or in combination: for example, chromium salts such as chromium alum and chromium acetate, aldehydes such as formaldehyde, glyoxal and glutaraldehyde, N-methylol compounds such as dimethylolurea and methyloldimethylhydantoin, dioxane derivatives such as 2,3-dihydroxydioxane, reactive vinyl compounds such as 1,3,5-triacryloyl-hexahydro-s-triazine, bis(vinylsulfonyl) methyl ether and N,N'-methylene-bis[β-(vinylsulfonyl) propionamide), reactive halogen compounds such as 2,4-dichloro-6-hydroxy-strizine, mucohalogenic acids such as mucochloric acid and phenoxymucochloric acid, isooxazoles, dialdehyde starch, 2-chloro-6-hydroxytriazine derivative of gelatin and carboxylgroup reactive type hardeners. These hardeners are described in Research Disclosure 176, 17643, p. 26, Items A to C, December 1978. Among them, the carboxyl group-reactive type hardeners are preferred. Preferable such the hardeners are ones represented by Formulas (1) to (7) described in JP O.P.I. 5-289219/1993, pages 3–5, and examples of them are Compounds H-1 to H-39 described on pages 6 to 14 of the same publication.

In the light-sensitive material, various additives such as a desensitizer, plasticizer, lubricant, development accelerator or oil may also be used other than the above-mentioned.

The support usable in the invention may be either one transparent or opaque, a transparent plastic support is suitable for the purpose of the invention. As the plastic support, that composed of a polyethylene compound (such as polyethylene terephthalate or polyethylene naphthalate), triacetate compound (such as cellulose triacetate) or polystyrene compound are preferably usable. Among them, a expanded film composed of a styrene copolymer having a syndiotactic structure or a composition containing such the styrene copolymer is preferred as the plastic support (hereinafter referred to SPS) . Although SPS means a homopolymer composed of a SPS constituent unit having syndiotactic steric regularity, a SPS modified by a small amount, not more than 20 mole-%, preferably not more than 10 mole-%, more preferably not more than 5 mole-%, of a secondary component is included. As the secondary component, for example, an olefin monomer such as ethylene, propylene, butene and hexene, a diene monomer such as butadiene and isoplene, a cyclic olefin monomer, a cyclic diene monomer, a polar vinyl monomer such as methyl methacrylate, maleic anhydride and acrylonitrile are cited. The SPS may be prepared by polymerizing styrene or its derivative under a suitable condition using an organic metal catalyst. Syndiotactic polystyrene has a racemidiad steric regularity of not less that 70%, preferably not less than 80%, and a racemipentad steric regularity of not less than 30%, preferably not less than 50%. In such the case, an ordinary plasticizer may be added as a secondary component within the range in which the bending elasticity is not degraded. The addition of the plasticizer is applied to obtain a suitable bending elasticity.

The SPS can be synthesized by polymerization of styrene or its derivation at a suitable temperature in the presence of a titanium compound and trialkyl aluminum. The methods described in JP O.P.I. Nos. 62-187708/1987, 1-46912/1989 and 1-178505/1998 can be referred for preparation of the SPS. Although there is no limitation of the molecular weight of the SPS, one having a molecular weight of 10,000 to 5,000,000 is preferable usable. It is necessary to select the optimal expanding condition for raising the bending elasticity of the SPS. The film is longitudinally expanded to 3.3 ±0.3 times in the at 120° C. ±25° C., which is a temperature higher by 30° C. ±25° C. than the glass transition point of the film before expantion. Then the film is expanded to 3.6±0.6 times in the lateral direction at the same temperature. The film is thermally treated at 230°±18° C. after expansion. The thermal treatment by two steps gives better results than the one step treatment. Thus a SPS film having a bending elasticity of not less than 350 kg/mm$^2$ is prepared.

It is difficult to strongly adhere the photographic layer to the support by coating the layer on the film having such the high bending elasticity with no treatment. The methods described in many patents and publications cited in JP O.P.I. 3-54551/1991 can be referred.

For example, a corona discharge treatment and provision of a subbing layer are described in the publications with respect to the surface treatment. As a material of the subbing layer, polymers of vinylidene chloride, methacrylic acid, acrylic acid, itaconic acid and maleic anhydride are cited.

The thickness of the support is preferably 50 to 250 μm, more preferably 70 to 200 μm.

A thermal treatment after preparation of the film is preferably applied for improving the winding habit and curing of the support. Although it is most preferred to apply the treatment at a time between the completion of film preparation and the start of emulsion layer coating, the treatment may be applied after the emulsion coating. The thermal treatment preferably carried out at a temperature of 45° C. to the glass transition point for a time of 1 second to 10 days. The treatment time of not more than 1 hour is preferred from the viewpoint of production efficiency.

It is preferred in the invention that a compound described below is added in a constituent layer of the silver halide photographic light-sensitive material.

(1) Compound having an acidic group.

Compounds described in JP O.P.I. 62-237445, page 292 (8), lower left column, line 11, to page 309(25), lower left column, line 3

(2) Acidic polymer

Compounds described in JP O.P.I. 6-186659, page (10) [0036] to page (17) [0062]

(3) Sensitizing dye

Compounds described in JP O.P.I. 5-224330, page (3) [0017] to page (13) [0040]

Compounds described in JP O.P.I. 6-194771, page (11) [0042] to page (22) [0094]

Compounds described in JP O.P.I. 6-242533, page (2) [0015] to page (8) [0034]

Compounds described in JP O.P.I. 6-337492, page (3) [0012] to page (34) [0056]

Compounds described in JP O.P.I. 6-337494, page (4) [0013] to page (14) [0039]

(4) Supersensitizer

Compounds described in JP O.P.I. 6-347938, page (3) [0011] to page (16) [0066]

(5) Tetrazolium compound Compounds described in JP O.P.I. 6-208188, page (8) [0059] to page (10) [0067]

(6) Pyridinium compound

Compounds described in JP O.P.I. 7-110556, page (5) [0028] to page (29) [0068]

(7) Redox compound

Compounds described in JP O.P.I. 4-245243, page 235(5) to page 250(22)

The above-mentioned additives and other know additives are described in Research Disclosure Nos. 17643 (December 1978), 18716 (November 1979) and 308119 (December 1989). The kind of compound and the position of the description in the three Research Disclosures are listed in the following table.

TABLE 1

| | RD-17643 | | | RD-308119 | |
|---|---|---|---|---|---|
| Additive | Page | Classi-fication | RD-18716 Page | Page | Classi-fication |
| Chemical sensitizer | 23 | III | 648 UR | 996 | III |
| Sensitizing dye | 23 | IV | 648–649 | 996–998 | IVA |
| Desensitizing dye | 23 | IV | | 998 | IVB |
| Dye | 25–26 | VIII | 649–650 | 1003 | VIII |
| Development accelerator | 29 | XXI | 648 UR | | |
| Antifoggant | 24 | IV | 649 UR | 1006–1007 | VI |
| Stabilizer | | | | 1007 | |
| Whitening agent | 24 | V | | 998 | V |
| Hardener | 26 | X | 651 L | 1004–1005 | X |
| Surfactant | 26–27 | XI | 650 R | 1005–1006 | XI |
| Antistatic agent | 27 | XII | 650 R | 1006–1007 | XIII |
| Plasticizer | 27 | XII | 650 R | 1006 | XII |
| Lubricant | 27 | XII | | | |
| Matting agent | 28 | XVI | 650 R | 1008–1009 | XVI |
| Binder | 26 | XXII | | 1003–1004 | IX |
| Support | 28 | XVII | | 1009 | XVII |

UR: Upper right column
L: Left column
R: Right column

The photographic additives may be used in a form of solution of water or an organic solvent. The additives may also be used in a form of dispersion of fine particles of crystal in water, gelatin, or a hydrophilic or hydrophobic polymer when the additive is hardly soluble in water. The dye, desensitizing dye, hydrazine, redox compound antifoggant or UV absorbent may be dispersed by a known dispersing machine. A ball mill, sand mill, colloid mill, ultrasonic dispersing apparatus and a high-speed impeller dispersing apparatus is cited in concrete. The fine particle dispersion of photographic additive may have an average size of not more than 100 μm, and is usually used in the form of fine particles having an average diameter of 0.02 to 10 μm.

The following methods may be applied for dispersing the additives: a high-speed mechanical stirring method described in JP O.P.I. No. 58-105141, a method by which the additive is dissolved in an organic solvent by heating and added into an aqueous solution of gelatin or a hydrophilic polymer containing a surfactant or a defoaming agent while dispersing, then the solvent is removed, (JP O.P.I. No. 44-22948), a method by which the additive dissolved in an acid such as citric acid, acetic acid, sulfuric acid, hydrochloric acid or malic acid is recrystallized and dispersed in a polymer solution having a pH value of 4.5 to 7.5 described in JP O.P.I. No. 50-80119 and a method by which the additive dissolved in an alkali such as sodium hydroxide, sodium hydrogen carbonate or sodium carbonate is recrystalllized and dispersed in a solution of polymer such as gelatin having a pH value of 4.5 to 7.5 described in JP O.P.I. No. 2-15252. For example, a hydrazine compound difficultly soluble in water can be dissolved referring JP O.P.I. No. 2-3000, and this method can be applied to the other additives. The fixing ratio of the fine crystal particle of the dye, sensitizing dye and inhibitor each having a carboxyl group can be raised by utilizing the chelating ability of the carboxyl group. Namely, it is preferred to add a calcium ion or magnesium ion in an amount of 200 to 4000 ppm. to the hydrophilic colloid layer. Another salt may be used without any limitation as long as it can be form a hardly soluble salt. The fine particle dispersion method is optionally applied to the sensitizer, dye, inhibitor, accelerator, hardener or hardener aid according to the physical property thereof.

A known slide hopper coating method or curtain coating method described in U.S. Pat. Nos. 3,636,374 and 3,508,947 may be applied for simultaneously coating plural constituent layers, two to 10 layer, of the invention with a high speed of 30 to 1000 meter per minute. It is preferable to use the above-mentioned hydrophilic polymer to inhibit ununiformity of the coating layer. By the hydrophilic polymer, the surface tension of coating liquid can be lowered and thixotropical property is given to the coating liquid. In the liquid having the thixotropical property, the viscosity is lowered by applying shearing stress.

A known method is used for packaging the photographic light-sensitive material of the invention.

It is preferred to avoid to store the silver halide photographic material under a serious condition since the light-sensitive material is sensitive to heat and humidity. Generally, the storage is preferably carried out at a temperature of 5° C. to 30° C. The humidity is preferably controlled within the relative humidity range of 35% to 60%. Generally, packaging by using 1 to 100 μm of polyethylene is applied to protect the light-sensitive material from the humid. Permeation of moisture can be inhibited by raising the crystal regularity of the polyethylene by using a metallocene catalyst. Moisture permeation can also be inhibited by covering the surface of polyethylene with a evaporation layer of silica of 0.1 to 1000 μm.

In the invention, it is preferred that the light-sensitive material is processed by using a developer replenisher prepared from a solid processing composition.

In the invention, the solid processing composition is a composition solidified in a form of powder, tablet, pill or granule, which is subjected to a moisture-proof treatment according to necessity. Ones in a form of paste or slurry are not included in the solid processing composition, which are semi-liquid state and inferior in the stability. Ones having a form to be regulated by the reason of dangerousness in the transportation are also not included.

The "powder" means a mass of fine crystals. In the invention, the "granule" means grain-shaped matter having a grain size of 50 to 5000 μm which are prepared from powder by a granulation treatment. The "tablet" means a matter tableted in a certain shape by compressing power or granules.

Among the above-mentioned solid processing composition, the tablet is preferably used since the tablet can be easily handled and the replenishing can be carried out with a high accuracy.

Optional means such as a method by which a concentrated solution or powder of photographic processing composition is kneaded with a water-soluble binder and shaped or a method by which a water-soluble binder is sprayed on the surface of provisionally shaped photographic processing composition to form a covering layer thereon, can be applied for solidifying the processing composition, cf. JP O.P.I. Nos. 4-29136, 485535, 4-85536, 4-85533, 4-85534 and 4-172301.

A method by which powdered solid processing composition is granulated and tableted is preferred for preparing the tablet. Such prepared tablet is advantageous in that the solubility and storage ability is improved, as a result of that the photographic property of the processing composition is stabilized, compared with a tablet simply prepared by mixing and tableting the raw materials of solid processing composition.

In the granulation method for the tablet formation, a known method such as a tumbling granulation, extrusion granulation, compression granulation, crushing granulation, stirring granulation, fluidized bed granulation and spray-dry granulation may be applied. The granules having an average diameter of 100 to 800 μm, more preferably 200 to 750 μm, are preferably usable for forming the tablet by the reason of that the ununiformity of the composition so-called segregation is difficultly occurred. The distribution of the granule size in which the sizes of granules of not less than 60% of the whole granules are within the deviation of ±100 to 150 μm is preferable. A known compressing machine, for example, an oil compressing machine, single tableting machine, rotary tableting machine and bricketing machine are usable. Although the compressed and shaped solid processing composition may has an optional shape, a cylindrical form or a form of tablet is preferred from the viewpoint of the production efficiency, easy handling and protection of dust formation at the place of practical use.

It is further preferable for enhancing the above-mentioned effects that an alkaline agent, reducing agent and preservant are separately granulated from each other.

The tableted processing composition may be prepared by the usual methods described in, for example, JP O.P.I. Nos. 51-61837, 54-155038 and 52-88025 and British Patent No. 1,213,808. The granulated processing composition may be prepared by the usual method described in, for example, JP O.P.I. Nos. 2-109042, 2-109043, 3-39735 and 3-39739. The powdered processing composition may be prepared by the usual methods described in, for example, JP O.P.I. No. 54133332/1979, British Patent Nos. 725,892 and 729,862, and German Patent No. 3,733,861.

When the solid processing composition is in the form of tablet, the bulk density thereof is preferably 1.0 g/cm$^3$ to 2.5 g/cm$^3$ from the viewpoint of dissolving ability and the effects of the invention. The bulk density of not less than 1.0 g/cm$^3$ is preferable at the point of strength of solidified matter and that not more than 2.5 g/cm$^3$ is preferable at the point of dissolving ability. When the solid processing composition is in the form of powder or granule, ones having a bulk density of 0.40 to 0.95 g/cm$^3$ are preferable.

Although the solid processing composition can be applied to a developing solution or fixing solution, it may also be applied to another solution such as a rinsing solution.

In the embodiment of the invention, it is preferred at least the developing composition is solidified even though it is most preferred that all kinds of processing composition are solidified. Effects of the solidification of the processing composition are most considerably appeared when the developing composition is solidified since many components reactable with together together and a harmful component are contained in the developer composition. Further, other than the developing composition, the fixing composition is preferably solidified. These composition are usually transported in a form of a kit of separately packages of liquids and the dangerousness in the transportation is noted as a problem.

Although solidification of a part of processing composition may be solidified, it is preferable that all the components are solidified. It is preferable that the components are each separately formed as an individual solid processing composition and the same number of solidified compositions are each packed.

When a developer composition is solidified, it is preferable embodiment of the invention that an alkaline agent and reducing agent are all solidified in not more than three tablets, most preferably one tablet. When the composition is solidified in two or more composition, the plural tablet or granulated composition are preferably packed in the same package.

As the packaging material for the solid processing composition, a synthesized resin material such as polyethylene including one prepared by high-pressure method or one prepared by low-pressure method, an unstretched or stretched polypropylene, polyvinyl chloride, polyvinyl acetate, Nylon (stretched or unstretched), polyvinylidene chloride, polystyrene, polycarbonate, Vinylon, Eval, polyethylene terephthalate (PET), polyesters other PET, hydrochloric acid rubber, acrylonitrile/butadiene copolymer, epoxy-phosphoric acid type resin such as polymers described in JP O.P.I. Nos. 63-63037 and 57-32952, and pulp.

Although two or more of the above-mentioned films are preferably laminated to use for packaging the solidified processing composition, a single film or a film on which another material is coated are usable.

It is more preferably to provide various type of gas barrier layer such as an aluminum foil or an aluminum evaporated synthetic resin layer between the above-mentioned resin layers.

The oxygen permeability of the packaging material is preferably not more than 50 ml/m$^2$.24 hr. atm, more preferably 30 ml/m$^2$.24 hr. atm, (at 20° C. and 65% RH) for raising the stability of the solid processing component and preventing stain formation.

The total thickness of the above laminated layers or the single layer is 1 to 3000 μm, more preferably 10 to 2000 ρm, further preferably 50 to 1000 μm.

The above-mentioned synthetic resin film may be a single macromolecular resin layer or a laminated layer composed of two or more macromolecular resin layers.

When the processing composition is packaged or bound by a water-soluble film or a binder, a water soluble film or a binder composed of a material of polyvinyl alcohol type, methyl cellulose type, polyethylene oxide type, starch type, polyvinylpyrrolidone type, hydroxypropyl cellulose type, pullulan type, dextran type, gum arabic type, polyvinyl acetate type, hydroxyethyl cellulose type, carboxyethyl cellulose type, sodium salt of carboxymethylhydroxyethyl cellulose type, poly(alkyl)oxazoline type and polyethylene glycol type is preferably usable. Among them, polyvinyl alcohol type and pullulan type are particular preferred from the viewpoint of effects of covering and binding.

The thickness of the above-mentioned water-soluble film is preferably 10 to 120 μm, more preferably 15 to 80 μm, particularly preferably 20 to 60 μm from the view point of the storage stability of solid processing composition, dissolving time of the water-soluble film and the crystal precipitation in an automatic processor.

The water-soluble film is preferably has a thermoplastic property, by which the film can be easily sealed by heat or ultrasonic adhesion, and the covering effect of the film is enhanced.

The tensile strength of the water-soluble film is preferably 0.5×106 to 50×106 kg/m$^2$, more preferably 1×106 to 25×106 kg/m$^2$, particularly 1.5×10 to 10×106 kg/m$^2$. The strain strength is determined by the method described in JIS Z-1521.

The photographic processing composition covered or bound by the water-soluble film or binder is preferably packaged by a moisture-proof packaging material to protect from the damage caused by accidental contact to the moisture of the air such as high humidity, rain and fog, or to water spattered or adhered on hand in the course of storage, transportation and handling. A film having a thickness of 10 to 150 μm is preferred as the moisture-proof packaging material. The moisture-proof packaging material is preferably one selected from a film of polyolefin such as polyethylene terephthalate, polyethylene or polypropylene, a craft paper given a moisture-proof ability by polyethylene, wax paper, moisture-proof cellophane, glassine paper, polyester, polystyrene, polyvinyl chloride, polyvinylidene chloride, polyamide, polycarbonate or acrylonitrile, and a foil of metal such as aluminum and metallized polymer film. A complex material composed of the above-mentioned materials is also usable.

A degradable plastic, particularly a bio-degradable or photo-degradable plastic, is preferably usable.

The above-mentioned bio-degradable plastic includes one composed of a natural macromolecular substance, a polymer produced by a microorganism, a synthetic polymer having a high bio-decomposability. The photo-degradable plastic includes one having a group in the main chain which causes cleavage of the chain when the group is exited by UV. A plastic having both of the functions of photo-decomposition and bio-decomposition is preferably usable.

Concrete examples of the above-mentioned are described below.

Bio-degradable plastic (1) Natural macromolecular substance

Polysaccharides, cellulose, polylactic acid, chitin, chitosan, polyamino acid and decorative thereof (2) Polymer produced by microorganism Bipol composed of copolymer of 3-hydroxy- butyrate and 3-hydroxyvalerate (PHE-PH) and cellulose produced by microorganism (3) Synthetic polymer having a high bio-decomposability Polyvinyl alcohol, polycaprolactone and a copolymer or mixture thereof (4) Combination of bio-degradable natural micromolecular substance with plastic A natural macromolecular substance having a high bio-degradability such as starch and cellulose is combined with a plastic for giving a shape-collasping ability.

Photo-degradable plastic (1) A plastic in which a carbonyl group is introduced for giving a photo-collasping ability. A UV absorbent may be added for accelerating the collapse of the plastic.

As the above-mentioned degradable plastic, ones described in "Kagaku to Kogyo", vol. 64, No. 10, p.p. 478–484, 1990, "Kinou Zairyo", p.p. 23–34, July 1990, are usually usable. Degradable plastics available on the market such as Biopol (manufactured by ICI Co.), Eco (Manufactured by Union Carbide Co.), Ecolite (Manufactured by Eco Plastic Co.) and Ecostar (manufactured by St. Lawrence Starch Co.) are usable.

The moisture permeability of the above moisture-proof packaging material is preferably not more than 10 g.mm/m$^2$.24 hr, more preferably not more than 5 g.mm/m$^2$.24 hr.

At least one of the developer and developer replenisher preferably contains ascorbic acid or a derivative thereof for developing the black-and-white silver halide photographic light-sensitive material of the invention. As ascorbic acid or the derivative thereof, a compound represented by the following Formula A is preferable.

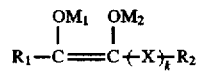

Formula A

In Formula A, $R_1$ and $R_2$ are each independently an alkyl group, an amino group or an alkylthio group, the alkyl group, the amino group and the alkylthio group each may have a substituent, and $R_1$ and $R_2$ may be bonded with each other to form a ring. k is 0 or 2 and X is —CO— or —CS— when X is 1. $M_1$ and $M_2$ are each a a hydrogen atom or an alkali metal atom.

A compound represented by Formula A-a is preferred, in which $R_1$ and $R_2$ in the above Formula A are bonded to form a ring.

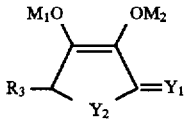

Formula A-a

In Formula A-a, $R_3$ is a hydrogen atom, a substituted or unsubstituted aryl group, a substituted or unsubstituted amino group, a substituted or unsubstituted alkoxy group, a sulfo group, a carboxyl group, an amido group or a sulfonamido group. $Y_1$ is O or S. $Y_2$ is O, S, or $NR_4$. $R_4$ is a substituted or unsubstituted alkyl group or a substituted or unsubstituted aryl group. $M_1$ and $M_2$ are each a hydrogen atom or an alkali metal atom.

Examples of the substituent of the above-mentioned alkyl group include a halogen atom such as Cl and Br, a hydroxyl group, an aryl group having 6 to 20 carbon atoms such as a phenyl group and aryl group, a heterocyclic group such as a 2,2,6,6-tetramethylpiperidyl group, quinolidinyl group, N,N-diethylpyrazolidinyl group and pyridyl group, an alkoxy group having 1 to 20 carbon atoms such as a methoxy group and ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as propagyloxy group, a heterocyclic oxy group such as pyridyloxy group, an acylamino group having 1 to 26 carbon atoms such as an acetylamino group, heptylamino group and propionylamino group, and an amino group such as an amino group, methylamino group, dimethylamino group and benzylamino group.

Examples of the substituent of above-mentioned amino group include a halogen atom such as Cl and Br, a hydroxyl group, an aryl group having 6 to 20 carbon atoms such as a phenyl group and naphthyl group, an alkyl group having 1 to 20 carbon atoms such as a methyl group, ethyl group, butyl group, cyclohexyl group, isopropyl group and dodecyl group, a heterocyclic group such as a 2,2,6,6-tetramethylpiperidyl group, quinolidinyl group, N,N'-diethylpyrazolidinyl group and pyridyl group, an alkoxy group, having 1 to 20 carbon atoms such as a methoxy group and ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as a propagyloxy group, a heterocyclic oxy group such as pyridyloxy group, and an acyl group having 1 to 20 carbon atoms such as an acetyl group, heptyl group and propionyl group.

Examples of the substituent of the above-mentioned aryl group include a halogen atom such as Cl and Br, a hydroxyl group, an alkyl group having 1 to 20 carbon atoms such as a methyl group, ethyl group, butyl group, cyclohexyl group, isopropyl group and dodecyl group, a heterocyclic group such as a 2,2,6,6-tetramethylpiperidyl group, quinolidinyl group, N,N'-diethylpyrazolidinyl group and pyridyl group, an alkoxy group, having 1 to 20 carbon atoms such as a methoxy group and ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as a propagyloxy group, a heterocyclic oxy group such as a pyridyloxy group, an acylamono group having 1 to 26 carbon atoms such as an acetylamino group, heptylamino group and propionylamino group and an amino group such as an amino group, methylamino group, dimethylamino group and benzylamino group.

Examples of the substituent of the above-mentioned alkoxy group include a halogen atom such as Cl and Br, a hydroxyl group, an aryl group having 6 to 20 carbon atoms (such as a phenyl group and naphthyl group, an alkyl group having 1 to 20 carbon atoms such as a methyl group, ethyl group, butyl group, cyclohexyl group, isopropyl group and dodecyl group, a heterocyclic group such as a 2,2,6,6-tetramethylpiperidyl group, quinolidinyl group, N,N'-diethylpyrazolidinyl group and pyridyl group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as a propagyloxy group, a heterocyclic oxy group such as a pyridyloxy group, an acylamino group having 1 to 26 carbon atoms such as an acetylamino group, heptylamino group and propionylamino group and an amino group such as an amino group, methylamino group, dimethylamino group and benzylamino group.

Examples of the substituent of the above-mentioned sulfo group, amido group and sulfonamido group include a halogen atom such as Cl and Br, a hydroxyl group, an alkali metal atom such as sodium and potassium, an aryl group having 6 to 20 carbon atoms such as a phenyl group and naphthyl group, an alkyl group having 1 to 20 carbon atoms such as a methyl group, ethyl group, butyl group, cyclohexyl group, isopropyl group and dodecyl group, a heterocyclic group such as a 2,2,6,6-tetramethylpiperidyl group, quinolidinyl group, N,N'-diethylpyrazolidinyl group and pyridyl group, an alkoxy group having 1 to 20 carbon atoms such as a methoxy group and ethoxy group, an aryloxy group having 6 to 20 carbon atoms such as a phenoxy group, an alkenyloxy group having 1 to 20 carbon atoms such as an allyloxy group, an alkynyloxy group having 1 to 20 carbon atoms such as a propagyloxy group, a heterocyclic oxy group such as a pyridyloxy group, an acylamino group having 1 to 26 carbon atoms such as an acetylamino group, heptylamino group and propionylamino group and an amino group such as an amino group, methylamino group, dimethylamino group and benzylamino group.

Examples of the compound represented by Formula (A) or (A-a) are shown below, the invention is not limited thereto.

Formula (A)

| No. | X | $R_1$ | $R_2$ | $M_1$ | $M_2$ |
|---|---|---|---|---|---|
| A-1 | — (k = 0) | $HOCH_2-\underset{\underset{OH}{\vert}}{CH}-\underset{\underset{OH}{\vert}}{CH}-$ | $-OH$ | H | H |
| A-2 | — (k = 0) | $HOCH_2-\underset{\underset{OH}{\vert}}{CH}-\underset{\underset{OH}{\vert}}{CH}-$ | $-OH$ | H | Na |
| A-3 | — (k = 0) | $HOCH_2-\underset{\underset{OH}{\vert}}{CH}-\underset{\underset{OH}{\vert}}{CH}-$ | $-CH_3$ | H | H |
| A-4 | — (k = 0) | $HOCH_2-\underset{\underset{OH}{\vert}}{CH}-\underset{\underset{OH}{\vert}}{CH}-$ | $-C_2H_5$ | H | H |
| A-5 | — (k = 0) | $CH_3\underset{\underset{OH}{\vert}}{CH}-\underset{\underset{OH}{\vert}}{CH}-$ | $-OH$ | H | H |

-continued

| | | | | | |
|---|---|---|---|---|---|
| A-6 | — (k = 0) | $CH_3.CH(OH)-CH(OH)-$ | $-OH$ | H | Na |
| A-7 | — (k = 0) | $CH_3.CH(OH)-CH(OH)-$ | $-CH_3$ | H | H |
| A-8 | — (k = 0) | $CH_3.CH(OH)-CH(OH)-$ | $-CH_3$ | Na | H |
| A-9 | — (k = 0) | $CH_3.CH(OH)-CH(OH)-$ | $-C_2H_5$ | H | H |
| A-10 | $-C(=O)-$ (k =1) | $HOCH_2-CH(OH)-CH(OH)-$ | $-OH$ | H | H |
| A-11 | $-C(=O)-$ (k =1) | $HOCH_2-CH(OH)-CH(OH)-$ | $-OH$ | Na | H |
| A-12 | $-C(=O)-$ (k =1) | $HOCH_2-CH(OH)-CH(OH)-$ | $-CH_3$ | H | H |
| A-13 | $-C(=O)-$ (k =1) | $HOCH_2-CH(OH)-CH(OH)-$ | $-CH_3$ | H | Na |
| A-14 | $-C(=O)-$ (k =1) | $HOCH_2-CH(OH)-CH(OH)-$ | $-C_2H_5$ | H | H |
| A-15 | $-C(=O)-$ (k =1) | $CH_3.CH(OH)-CH(OH)-$ | $-OH$ | H | H |
| A-16 | $-C(=O)-$ (k =1) | $CH_3.CH(OH)-CH(OH)-$ | $-OH$ | Na | H |
| A-17 | $-C(=O)-$ (k =1) | $CH_3.CH(OH)-CH(OH)-$ | $-CH_3$ | H | H |
| A-18 | $-C(=O)-$ (k =1) | $CH_3.CH(OH)-CH(OH)-$ | $-C_2H_5$ | H | H |
| A-19 | $-C(=O)-$ (k =1) | $HO-CH_2-$ | $-OH$ | H | H |
| A-20 | $-C(=O)-$ (k =1) | $HO-CH_2-$ | $-OH$ | H | Na |
| A-21 | $-C(=O)-$ (k =1) | $HO-CH_2-$ | $-CH_3$ | H | H |
| A-22 | $-C(=O)-$ (k =1) | $HO-CH_2-$ | $-C_2H_5$ | H | H |
| A-23 | $-C(=O)-$ (k =1) | $HO-CH_2-$ | $-C_2H_4OH$ | H | H |
| A-24 | $-C(=O)-$ (k =1) | $HO-CH_2-$ | $-C_2H_4OH$ | H | Na |
| A-25 | $-C(=S)-$ (k = 1) | $HOCH_2CH(OH)-CH(OH)-$ | $-OH$ | H | H |
| A-26 | $-C(=S)-$ (k = 1) | $HOCH_2CH(OH)-CH(OH)-$ | $-OH$ | H | Na |

-continued

| | | | | | |
|---|---|---|---|---|---|
| A-27 | $-C(=S)-$ (k = 1) | $HOCH_2CH(OH)-CH(OH)-$ | $-CH_3$ | H | H |
| A-28 | $-C(=S)-$ (k = 1) | $CH_3.CH(OH)-CH(OH)-$ | $-OH$ | H | H |
| A-29 | $-C(=S)-$ (k = 1) | $CH_3.CH(OH)-CH(OH)-$ | $-OH$ | H | Na |
| A-30 | $-C(=S)-$ (k = 1) | $CH_3.CH(OH)-CH(OH)-$ | $-CH_3$ | Na | H |

Formula (A-a)

| No. | $Y_1$ | $Y_2$ | $R_3$ | $M_1$ | $M_2$ |
|---|---|---|---|---|---|
| A-31 | O | O | H | H | H |
| A-32 | O | O | $CH_3$ | H | H |
| A-33 | O | O | $CH_3$ | H | Na |
| A-34 | O | O | $CH_3$ | Na | H |
| A-35 | O | O | $CH_2(OH)$ | H | H |
| A-36 | O | O | $CH_2(OH)$ | H | Na |
| A-37 | O | O | $CH_3.CH(OH)-$ | H | H |
| A-38 | O | O | $CH_3.CH(OH)-$ | H | Na |
| A-39 | O | O | $HOCH_2.CH(OH)-$ | H | H |
| A-40 | O | O | $HOCH_2.CH(OH)-$ | H | Na |
| A-41 | O | O | $HOCH_2.CH(OH)-$ | Na | H |
| A-42 | O | O | $ClCH_2.CH(OH)-$ | H | H |
| A-43 | O | O | $ClCH_2.CH(OH)-$ | Na | H |
| A-44 | O | O | $HOOCH_2.CH(OH)$ | H | H |
| A-45 | O | O | $HOOCH_2.CH(OH)$ | Na | H |
| A-46 | S | O | H | H | H |
| A-47 | S | O | H | H | Na |
| A-48 | S | O | $CH_3.CH(OH)-$ | H | H |
| A-49 | S | O | $CH_3.CH(OH)-$ | Na | H |
| A-50 | S | O | $HOCH_2.CH(OH)-$ | H | H |

-continued

| | | | | | |
|---|---|---|---|---|---|
| A-51 | S | O | $HOCH_2CH(OH)$— | Na | H |
| A-52 | O | $NCH_3$ | H | H | H |
| A-53 | O | $NCH_3$ | $HOCH_2CH(OH)$— | H | H |
| A-54 | O | $NCH_3$ | $HOCH_2CH(OH)$— | H | Na |
| A-55 | O | NH | $HOCH_2CH(OH)$— | H | H |
| A-56 | O | NH | $HOCH_2CH(OH)$— | Na | H |
| A-57 | O | S | $HOCH_2CH(OH)$— | H | H |
| A-58 | O | S | $HOCH_2CH(OH)$— | Na | H |
| A-59 | O | S | $HOCH_2CH(OH)$— | H | Na |
| A-60 | O | S | $CH_3CH(OH)$— | H | H |
| A-61 | S | S | H | H | H |
| A-62 | S | S | H | H | Na |
| A-63 | S | S | $CH_3CH(OH)$— | H | H |
| A-64 | S | S | $CH_3CH(OH)$— | Na | H |
| A-65 | S | S | $HOCH_2CH(OH)$— | H | H |
| A-66 | S | S | $HOCH_2CH(OH)$— | H | Na |
| A-67 | S | S | $HOCH_2CH(OH)$— | Na | H |
| A-68 | S | S | $HOCH_2CH(OH)$— | H | K |

These compounds are known as ascorbic acid or erythorbic acid or their derivatives are available on the market or can be easily synthesized by a known method.

In the invention, ascorbic acid or its derivative is preferably added into a developer replenisher even though it may be added into any of a developer replenisher, fixer replenisher and stabilizer replenisher.

In the invention, a developing agent (hydroxybenzenes such as hydroquinone, chlorohydroquinone, methylhydroquinone and sodium hydroquinonemonosulfate, 3-pyrazolidones such as 1-phenyl-3-pyrazolidone, 1-phenyl-4-methyl-3-pyrazolidone, 1-phenyl-4,4-dimetyl-3-pyrazolidone and 1-phenyl-4,4-dihydroxymetyl-3-pyrazolidone, an aminophenols such as N-methyl-p-aminophenol, and a mixture thereof, an alkaline agent such as sodium hydroxide and potassium hydroxide, and a pH buffering agent such as a carbonate, phosphate, boric acid, acetic acid, citric acid and alkanolamine are preferably added to the developer and/or the developer replenisher. As the pH buffering agent, the carbonate is preferred and the adding amount thereof is preferably within the range of from 0.5 moles to 2.5 moles more preferably 0.75 moles to 1.5 moles, per liter. A dissolving aid such as polyethylene glycols and their esters, and alkanolamine a sensitizer, a surfactant, a defoaming agent, an antifoggant, for example, a halide such as potassium bromide and sodium bromide, nitrobenzindazole, nitrobenzimidazole, benzotriazole, benzothiazole, tetrazoles and thiazoles, a chelating agent, for example, ethylenediaminetetraacetic acid and an alkali salt thereof, nitrilotriacetic acid and a polyphosphate, a development accelerator such as the compounds described in U.S. Pat. No. 2,304,025 and Japanese Patent 47-45541 or a hardener such as glutaraldehyde and a bisulfite adduct thereof may be added according to necessity.

It is preferred in the invention that the developer and/or the developer replenisher contain a silver sludge preventing agent. A compound represented by the following Formula S is preferably usable even though various compounds have been known as the silver sludge preventing agent.

Formula S $$Z^1—SM^1$$

In the formula, $Z^1$ represents an alkyl group, an aromatic group or a heterocyclic group each are substituted by at least one selected from the group consisting of a hydroxyl group, an $—SO_3M^2$ group, a $—COOM^2$ group, $M^2$ represents a hydrogen atom, an alkali metal atom or a substituted or unsubstituted ammonium ion), a substituted or unsubstituted amino group, and a substituted or unsubstituted ammonio group, or by a group having a substituent selected from the above group. $M^1$ represents a hydrogen atom, an alkali metal atom or a substituted or unsubstituted amidino group (which may be form a salt with a hydrogen halide or sulfonic acid).

The alkyl group represented by $Z^1$ is preferably a straight-, branched- or cyclic chain alkyl group having 1 to 30, particularly 2 to 20 carbon atoms, which may has further a substituent other than the above-mentioned substituent. The aromatic group represented by $Z^1$ is preferably single or condensed ring aromatic group having 6 to 32 carbon atoms, which may has a substituted further than the above-mentioned substituent. The heterocyclic group represented by $Z^1$ is a single ring or condensed ring heterocyclic group having 1 to 32 carbon atoms, and has 1 to 6 atoms independently selected from nitrogen, oxygen and sulfur in the 5- or 6-member ring thereof. The aromatic group may has a substituent further than the above-mentioned substituent. When the heterocyclic group is tetrazole, a substituted or unsubstituted naphthyl group is not to be the substituent.

The above-mentioned ammonio group is preferably one having not more than 20 carbon atoms, and a substituent thereof includes a substituted or unsubstituted straight-, branched- or cyclic chain alkyl group (such as a methyl group, ethyl group, benzyl group, ethoxypropyl group and cyclohexyl group) and a substituted or unsubstituted phenyl or naphthyl group.

Among the compounds represented by Formula S, a compound in which $Z^1$ is a heterocyclic ring having two or more nitrogen atoms is preferred.

Among the compounds represented by Formula S, a compound represented by the following Formula S-a is more preferable.

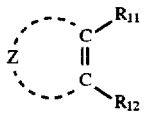

Formula S-a

In the formula, Z represents a group necessary to form a 5- or 6-member unsaturated heterocyclic group such as a pyrrole ring, imidazole ring, pyrazole ring, pirimidine ring, pyridazine ring or pyrazine ring. $R^{11}$ and $R^{12}$ are each represent a hydrogen atom, an —$S^1$ group, a halogen atom, an alkyl group including one having a substituent, an alkoxy group including one having a substituent, a hydroxy group, a —$COOM^2$ group, an —$SO_3M^2$ group, an alkenyl group, including one having a substituent, an amino group including one having a substituent, a carbamoyl group including one having a substituent or a phenyl group including one having a substituent. $R^{11}$ and $R^{12}$ may form a ring with each other. The ring formed by $R^{11}$ and $R^{12}$ is a 5- or 6-member ring, preferably a nitrogen-containing group.

The compound represented by Formula S-a at least has an —$SM^1$ group or a thione group and at least one substituent selected from the group consisting of a hydroxyl group, a —$COOM^2$ group, an —$SO_3M^2$ group, a substituted or unsubstituted amino group and a substituted or unsubstituted ammonio group. $M^1$ and $M^2$ are each the same as in $M^1$ and $M^2$ defined in Formula (S), respectively.

Z is a group for forming a heterocyclic compound including two or more nitrogen atom, which may have a substituent further than the above-mentioned —$SM^1$ group or thione group. As the substituent, a halogen atom (such as fluorine, chlorine and bromine), a lower alkyl group (including one having a substituent, preferably one having 5 or less carbon atoms such as a methyl group and ethyl group), a lower alkenyl group (including one having a substituent, preferably one having 5 or less carbon atoms), a carbamoyl group and phenyl group are cited.

Among the compounds represented by Formula S-a, a compound represented by the following Formula A, B, C, D, E or F is particularly preferred.

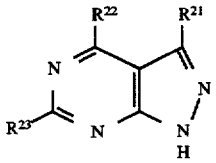

Formula A

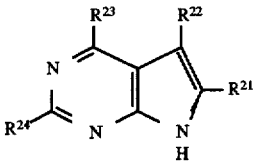

Formula B

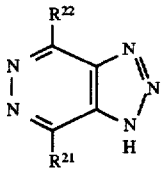

Formula C

-continued

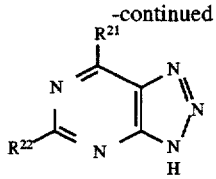

Formula D

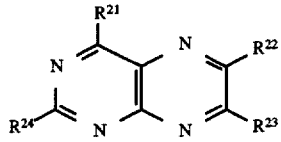

Formula E

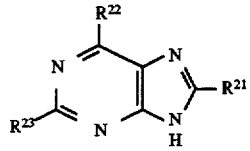

Formula F

In the formulas, $R^{21}$, $R^{22}$, $R^{23}$ and $R^{24}$ are each a hydrogen atom, an —$SM^1$ group, a halogen atom, a lower alkyl group including one having a substituent, preferably one having 5 or less carbon atoms such as a methyl group and ethyl group, a lower alkoxy group including one having a substituent, preferably one having 5 or less carbon atoms, a hydroxyl group, a —$COOM^1$ group, an —$SO_3M^3$ group, a lower alkenyl group including one having a substituent, preferably one having 5 or less carbon atoms, an amino group, a carbamoyl group, or a phenyl group, and at least one of which is an —$SM^1$ group. $M^1$, $M^2$ and $M^3$ are each a hydrogen atom, an alkali metal atom or an ammonium group, they may be the same or different. It is particularly preferred to has a water-solubilizing group such as a hydroxyl group, —$COOM^2$ group or —$SO_3M^3$ group or amino group. The amino group represented by $R^{21}$, $R^{22}$, $R^{23}$ or $R^{24}$ is a substituted or unsubstituted amino group. The preferable substituent of the amino group is a lower alkyl group. The ammonium group is a substituted or unsubstituted ammonium group, preferably an unsubstituted ammonium group.

Typical examples of compound of the silver sludge preventing agent represented by Formula S are shown below, the invention is not limited thereto.

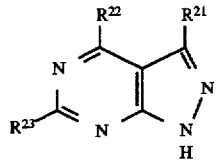

| | $R^{21}$ | $R^{22}$ | $R^{23}$ | $R^{24}$ |
|---|---|---|---|---|
| 1 | H | $NH_2$ | SH | |
| 2 | COOH | SH | H | |
| 3 | $CH_3$ | $SO_3Na$ | SNa | |
| 4 | OH | H | SH | |
| 5 | H | $NH_2$ | SH | |
| 6 | Cl | SH | COOH | |
| 7 | COOH | H | SH | |

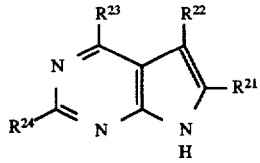

-continued

| | $R^{21}$ | $R^{22}$ | $R^{23}$ | $R^{24}$ |
|---|---|---|---|---|
| 8 | H | H | $NH_2$ | SH |
| 9 | Cl | H | OH | SH |
| 10 | SH | H | H | OH |
| 11 | $C_5H_{11}$ | H | $SO_3H$ | SH |
| 12 | OH | H | H | SH |
| 13 | H | H | OH | SH |
| 14 | SH | H | SH | OH |

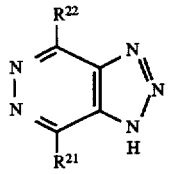

| | | |
|---|---|---|
| 15 | SH | $NH_2$ |
| 16 | SNa | $SO_3Na$ |
| 17 | SH | COOH |
| 18 | SH | $SO_3H$ |
| 19 | OH | SH |

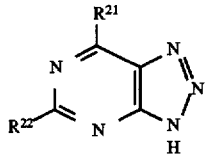

| | | |
|---|---|---|
| 20 | OH | SH |
| 21 | $NH_2$ | SH |
| 22 | SH | COOH |
| 23 | SH | $SO_3H$ |
| 24 | SH | OH |

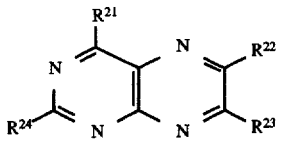

| | | | | |
|---|---|---|---|---|
| 25 | $NH_2$ | H | H | SH |
| 26 | COOH | H | SH | SH |
| 27 | OH | H | H | SH |
| 28 | $NH_2$ | $C_5H_{11}$ | H | SH |
| 29 | SH | COOH | H | H |
| 30 | H | H | $SO_3H$ | SH |

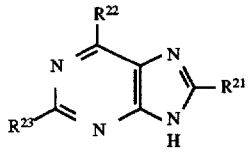

| | | | |
|---|---|---|---|
| 31 | SH | OH | H |
| 32 | SH | H | COOH |
| 33 | H | OH | SH |
| 34 | $SO_3H$ | SH | SH |
| 35 | H | SH | $SO_3H$ |
| 36 | $NH_2$ | H | SH |
| 37 | $NH_2$ | SH | H |
| 38 | H | $NH_2$ | SNa |
| 39 | SH | $NH_2$ | H |

40

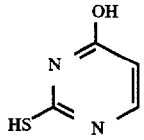

-continued

| | $R^{21}$ | $R^{22}$ | $R^{23}$ | $R^{24}$ |
|---|---|---|---|---|

41

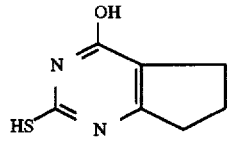

The using amount of the compound represented by Formula (S) is preferably $10^{-6}$ to $10^{-1}$ moles, more preferably $10^{-5}$ to $10^{-2}$ moles, per liter of developing solution.

The pH value of the developing solution is adjusted to not less than 9 and less than 11, more preferably 9.3 to 10.8.

As the fixing solution or/and fixer replenisher, ones having a usual composition are usable. A thiosulfate such as sodium thiosulfate, potassium thiosulfate and ammonium thiosulfate, a thiocyanate such as sodium thiocyanate, potassium thiocyanate and ammonium thiocyanate, and an organic sulfur compound capable of forming a water-soluble stable silver complex known as a fixing agent are usable as the fixing agent.

A water-soluble aluminum salt such as aluminum chloride, aluminum sulfate and potassium alum, and an aldehyde compound such as glutaraldehyde and sulfite adduct thereof which function as a hardening agent may be added to the fixing solution and/or fixer replenisher.

In the fixing solution and/or fixer replenisher, a preservant such as a sulfite and bisulfite, a pH buffering agent such as acetic acid and citric acid, pH controlling agent such as sulfric acid and a chelating agent having a water softening ability may be optionally contained.

The fixer replenisher is preferably a solid composition. The solid composition of fixer replenisher is preferably a single composition containing all necessary components, and is preferable granulated composition containing a hardener.

The pH of the fixing solution is preferably not less than 3 and less than 8.

The light-sensitive materials is treated by washing or a stabilizing bath after the fixing treatment. In the stabilizing bath, an inorganic and organic acid and their salt, an alkaline agent and its salt, for example, a combination of a borate, metaborate, borax, phosphate, carbonate, potassium hydroxide, sodium hydroxide, ammonia water, monocarboxylic acid, dicarboxylic acid, polycarboxylic acid, citric acid, oxalic acid, malic acid and acetic acid for controlling the pH of the layer to 3 to 8 after processing, aldehydes such as formaldehyde, glyoxal and glutaraldehyde, a chelating agent such as ethylenediaminetetraacetic acid and an alkaline salt thereof, nitrilotriacetic acid and a polyphosphate, and an antimold agent such as phenol, 4-chlorophenol, cresol, o-phenylphenol, chlorophen, dichlorophene, formaldehyde, an ester of p-hydroxybenzoic acid, 2-(4-thiazoline)-benzimidazole, benzoisothiazoline-3-one, dodecyl-benzyl-methylammonium chloride, N-(fluorodichloromethylthio)phthalimide), a tone controlling and/or color remaining improving agent, for example, a nitrogen-containing heterocyclic compound having a mercapto group as a substituent thereof such as sodium salt of 2-mercapto-5-sulfobenzimidazole, 1-phenyl-5-mercaptotetrazole, 2-mercaptobenzthiazole, 2-mercapto-5-propyl-1,3,4-triazole and 2-mercaptohypoxanthine are added for the purpose of stabilizing the image. It is preferred that the stabilizing solution contains the antimold agent among the above-mentioned additives. The above-mentioned components may be replenished in a form of either liquid or solid.

For satisfying the demand for reducing the amount of waste liquid, the replenishing amount for developer is preferably 20 ml to 200 ml, more preferably 30 to 190 ml, per square meter of the light-sensitive material to be processed. The replenishing amount is the amount to be replenished, in concrete, the volume of the solution prepared by dissolving the granulated developer composition in water.

The developer replenisher and fixer replenisher each may be the same with or different from the initial developer solution and initial fixing solution charged in the tank of the automatic processor, respectively.

The initial developing solution and the initial fixing solution each may be one prepared from a granulated composition or a concentrated liquid composition. A solution made to be directly used may also be usable.

Temperature at the steps of development, fixing, and washing and/or stabilizing is preferably within the range of 10° to 45° C., and the temperature may be separately controlled for each of the steps.

The total processing time from the time of insertion of the front of film into an automatic processor to coming out of from the drying zone (dry to dry), is preferably 10 to 60 seconds for satisfying the demand for reducing the processing time. The total processing time includes all the time necessary for processing a black-and-white light-sensitive material, in concrete, includes the time necessary for all processing of, for example, the development, fixing, washing, stabilizing and drying, namely dry to dry. When the total processing time is less than 10 seconds, a satisfactory photographic property cannot be obtained since desensitization and lowering in contrast are occurred. The total processing time (dry to dry) is more preferably 15 to 45 seconds. Further, it is preferred that the developing time is 2 to 22 seconds for stably running the processing of a lot of light-sensitive material of 100 $m^2$ or more.

For enhancing the effect of the invention, it is preferable to use an automatic processor having a drying zone in which a heat conducting means heated at 60° C. or more (for example a heat roller heated at 60° to 130° C.), or a heat radiating means heated at 150° C. or more.

A heating roller is cited as an example of the heat conducting means heated at 60° C. or more. The heat roller is preferably a hollow aluminum roller, the outer surface of which is covered with a silicone rubber, polyurethane or Teflon. It is preferable that the both ends of the heating roller are rotatably provided by heat resistive resin such as Rulon bearings on the side walls of the drying zone at a portion near the entrance of the drying zone.

It is preferable that a gear is fixed on one end of the heat roller and the roller is rotated in the transportating direction by a driving means and a driving force transmission means. It is preferable that a halogen heater is inserted in the roller and the heater is connected to a temperature controller provided in the automatic processor.

It is preferable that a thermistor contacted with the outer surface of the heating roller is connected to the temperature controller and the controller controls the temperature of the heating roller by a on/off method so that the temperature detected by the thermistor is within the range of 60° C. to 150° C., more preferably 70° C. to 130° C.

As examples of heat radiating body at 150° C. or higher (preferably 250° C. or higher), tungsten, carbon, tantalum, nichrome, a mixture of zirconium, yttrium oxide and thorium oxide, silicon carbide, molybdenum disilicide and lanthanum chromate are cited. The temperature of heat radiating body is controlled by directly applying an electric current. In another temperature controlling method, heat energy is conducted from an electroresistive heat generator to a heat radiating body. As the heat radiating body, copper, stainless steel, nickel and various ceramics are cited.

The heat conductive means maintained at not lower than 60° C. and the heat radiating means maintained at not lower than 150° C. may be used in combination. An ordinary drying by air heated at a temperature of not higher than 60° C. is also may be used in combination with the above means.

An automatic processor using the following methods or mechanisms is preferably used.

(1) Deorderizing device: JP O.P.I. No. 64-37560, upper left column on page 544(2) to left upper column on page 545(3)

(2) Cleaning agent and device for used washing water: JP O.P.I. No. 6-250253, [0011] on page (3) to [0058] on page (8)

(3) Waste liquid treatment method: JP O.P.I. No. 2-64638, page 388(2), lower left column to page 391(5), lower left column (4) Rinsing bath provided between developing bath and fixing bath: JP O.P.I. No. 4-313749, page (18), [0054], to page (21), [0065]

(5) Water replenishing method: JP O.P.I. No. 1-281446, page 250(2), lower left column to lower right column.

(6) Method for controlling drying air temperature in automatic processor by detecting temperature and humidity of outside air: JP O.P.I. No. 1-315745, page 496(2), lower right column, to page 501(7), lower right column, and JP O.P.I. No. 2-108051, page 588(2), lower left column, to page 589(3), lower left column (7) Method for recovering silver from waste liquid of fixing solution: JP O.P.I. No. 6-27623, page (4), [0012], to page (7), [0071]

EXAMPLES

The invention is described in detail blow according to examples. However, the invention is not limited thereto.

Example 1

(Preparation of silver halide emulsion A)

Core grains comprising 100 mole-% of silver chloride having an average diameter of 0.12 μm were prepared by a double-jet mixing method while adjusting $E_{ag}$ at 90 mV. At the step of mixing, $5\times10^{-5}$ moles per mole of silver of $K_2RuCl_5$ (NO) was added. A shell comprising 100 mole-% of silver chloride was formed on the surface of the core grain by a double-jet mixing method while controlling the silver electrode potential at 90 mV. At this time, $7.5\times10^{-5}$ moles per mol of silver of $K_2RuCl_5$(NO) was added. Thus obtained emulsion is an emulsion comprising core/shell type monodisperse, variation coefficient of 10%, silver chloride grains having an average diameter of 0.15 μm. Then the emulsion was desalted using a modified gelatin described in JP O.P.I. No. 2-280139, in the modified gelatin, the amino group was substituted by phenylcarbamoyl group such as exemplified compound G-8 in JP O.P.I. No. 2-280139. Before the desalting, $1\times10^{-3}$ moles per mole of silver of 4-hydroxy-6-methyl-1,3,3a,7-tetraazaindene was added, hereinafter, the amount of additive is described in per mole of silver when there is no specific description. The silver electrode potential after desalting was 190 mV at 50° C. Emulsions [B] to [D] were prepared in a manner similar to the above-mentioned. Distinctive features of Emulsions [A] to [D] are listed in Table 2.

TABLE 2

| Em No. | Silver halide emulsion: Halide composition | grain size (μm) | Transition metal complex: Core Kind | Core Added amount (mol/mol Ag) | Shell Kind | Shell Added amount (mol/mol Ag) | Note |
|---|---|---|---|---|---|---|---|
| A | $AgCl_{100}$ | 0.15 | $K_2Ru(NO)Cl_5$ | $5 \times 10^{-5}$ | $K_2Ru(NO)Cl_5$ | $7.5 \times 10^{-5}$ | Inventive |
| B | $AgCl_{100}$ | 0.15 | $(NH_4)_2OsCl_5$ | $5 \times 10^{-5}$ | $(NH_4)_2OsCl_5$ | $7.5 \times 10^{-5}$ | Inventive |
| C | $AgBr_5Cl_{95}$ | 0.15 | $K_2Ru(NO)Cl_5$ | $5 \times 10^{-5}$ | $K_2Ru(NO)Cl_5$ | $7.5 \times 10^{-5}$ | Inventive |
| D | $AgBr_{20}Cl_{80}$ | 0.15 | $K_2Ru(NO)Cl_9$ | $5 \times 10^{-5}$ | $K_2Ru(NO)Cl_5$ | $7.5 \times 10^{-5}$ | Comparative |

To each of thus obtained emulsions, $1\times10^{-3}$ moles of 4-hydroxy-6-methyl-1,3,3a,7-tetraazaindene was added, and then potassium bromide and citric acid were added to adjust pH and $E_{Ag}$ to 5.6 and 123 mV, respectively. Each of the emulsions was subjected to chemical ripening for 60 minutes at 60° C. after addition of $1\times10^{-5}$ moles of chloroauric acid, $3\times10^{-6}$ moles of elementary sulfur and $2\times10^{-6}$ moles of diphenylpentafluorophenyl selenide. After completion of the chemical ripening, $3\times10^{-3}$ moles of 4-hydroxy-6-methyl-1,3,3a,7-tetraazaindene, $3\times10^{-4}$ moles of 1-phenyl-5-mercaptotetrazole and gelatin were added. Then the emulsions were chilled to be set.

A first emulsion layer, second emulsion layer, lower protective layer and upper protective layer were simultaneously coated in this order from the support by a curtain coating method with a coating speed of 250 m/min. on a subbing layer of a side of a support so that the coating amounts per $m^2$ were to be those shown in Tables 3 and 4. Thus Samples 1 through 25 were prepared.

Further, Sample 26 was prepared in the same manner as in Sample 12 except that the fine solid dispersed particles of Dye O and Dye G in the upper protective layer were omitted.

<Drying conditions in Table 2>

Condition I: The maximum value of wet-bulb temperature when the weight ratio of water/gelatin binder was not less than 200%.

Condition II: The value of wet-bulb temperature when the weight ratio of water/gelatin binder was not more than 200%.

On a subbing layer of the opposite side of the support, an antistatic layer having the following composition was provided, and then a backing layer, a hydrophilic polymer layer and a backing protective layer were simultaneously coated in this order so that the coating amounts per $m^2$ were the following values to prepare the samples.

(Support, Subbing layer)

Both of the surface of a biaxially stretched polyethylene terephthalate support of thickness of 100 μm was subjected to 30 W/($m^2$.min.) of corona discharge, and a subbing layer having the following composition was coated on both side of the support and dried for 1 minute at 100° C.

| | |
|---|---|
| 2-hydroxyethyl methacrylate (25)-butyl acrylate (30)-t-butyl acrylate (26)-styrene (20) copolymer (numbers are weight ratio) | 1.5 g/$m^2$ |
| Surfactant A | 10 mg/$m^2$ |
| Hexamethylen-1,6-bis (ethyleneurea) | 15 mg/$m^2$ |

(Antistatic layer)

On the subbed polyethylene terephthalate support, 10 W/($m^2$.min.) of corona discharge was applied, and a antistatic layer having the following composition was coated with a speed of 70 m/min. by a roll-fit coating pan and an air knife on one side of the support and dried for 90 seconds at 140° C.

| | |
|---|---|
| Water-soluble electroconductive polymer B | 0.6 g/$m^2$ |
| Particles of hydrophobic polymer C | 0.4 g/$m^2$ |
| Polyethylene oxide compound D | 0.1 g/$m^2$ |
| Hardener E | 0.2 g/$m^2$ |
| (First emulsion layer) | |
| Emulsion (described in Table 3) | 1.5 g/$m^2$ in terms of Ag |
| Gelatin an amount necessary to make the coating amount to | 0.3 g/$m^2$ |
| Sodium salt of N-oleyl-N-methyltaurine | 35 mg/$m^2$ |
| Compound F | 10 mg/$m^2$ |
| Hydrazine derivative described in Tables 3 and 4 | (See Tables 3 and 4) |
| Nucleation accelerator: amine compound described in Tables 3 and 4 | (See Tables 3 and 4) |
| Nucleation accelerator: onium compound described in Tables 3 and 4 | (See Tables 3 and 4) |
| Choloroauric acid | 0.1 mg/$m^2$ |
| Sodium polystyrenesulfonate | 50 mg/$m^2$ |
| Hydrophilic copolymer of styrene-maleic acid | 20 mg/$m^2$ |
| Compound S (sodium iso-amyl-n-decylsulfosuccinate) | 5 mg/$m^2$ |
| 5-methylbenzotiazole | 10 mg/$m^2$ |
| Cyclodextrine (hydrophilic polymer) | 0.5 g/$m^2$ |
| (Second emulsion layer) | |
| Emulsion (described in Table 2) | 1 g/$m^2$ in terms of Ag |
| Gelatin | (See Tables 3 and 4) |
| Sodium salt of N-oleyl-N-methyltauline | 35 mg/$m^2$ |
| Nucleation accelerator: amine compound described in Tables 3 and 4 | (See Tables 3 and 4) |
| Nucleation accelerator: onium compound described in Tables 3 and 4 | (See Tables 3 and 4) |
| Compound I | 10 mg/$m^2$ |
| Adenine | 20 mg/$m^2$ |
| Compound J | 10 mg/$m^2$ |
| Compound U | 30 mg/$m^2$ |
| Latex polymer K | 1 g/$m^2$ |
| Colloidal silica (average diameter of 0.05 μm) | 100 mb/$m^2$ |
| Sodium polyetyrenesulfonate | 20 mg/$m^2$ |
| Compound S | 5 mg/$m^2$ |
| (Lower protective layer) | |
| Gelatin | (See Tables 3 and 4) |
| Hydroquinone | 50 mg/$m^2$ |
| Latex polymer K | 1 g/$m^2$ |
| Colloidal silica (average diameter of 0.05 μm) | 100 mb/$m^2$ |
| Sodium polyetyrenesulfonate | 11 mg/$m^2$ |
| Hydrophilic copolymer of styrene-maleic acid | 20 mg/$m^2$ |
| Compound S | 12 mg/$m^2$ |
| (Upper protective layer) | |
| Gelatin | (See Tables 3 and 4) |
| Water-soluble dye N | 30 mg/$m^2$ |

-continued

| | |
|---|---|
| Fine solid particles dispersion of Dye O (average particle size of 0.1 μm) | 30 mg/m² |
| Fine solid particles dispersion of Dye G (average particle size of 0.1 μm) | 30 mg/m² |
| Mating agent: irregular-shaped silica (average particle size of 1.63 μm) | 15.0 mg/m² |
| Mating agent: irregular-shaped silica (average particle size shown in table 2) | 21.0 mg/m² |
| Citric acid | 4.5 mg/m² |
| Sodium polystyrenesulfonate | 11.0 mg/m² |
| Hardener T | 5 mg/1 g of gelatin in the total layer |
| Surfactant M | 1 mg/m² |
| Compound S | 12 mg/m² |
| (Composition of backing layer) | |
| Gelatin | (See Tables 3 and 4) |
| Compound S | 5 mg/m² |
| Latex polymer K | 0.3 mg/m² |
| Colloidal silica (average diameter of 0.05 μm) | 70 mg/m² |
| Sodium polystyrenesulfonate | 20 mg/m² |
| Hardener E | 10 mg/m² |

-continued

| | |
|---|---|
| (Composition of hydrophobic polymer layer) | |
| Latex (methyl methacrylate:acrylic acid = 97:3) | 1.0 g/m² |
| Hardener L | 6 mg/m² |
| (Composition of backing protective layer) | |
| Gelatin | 0.5 g/m² |
| Water-soluble dye Q | 160 mg/m² |
| Water-soluble dye R | 30 mg/m² |
| Hydrophilic copolymer of styrene-maleic acid | 20 mg/m² |
| Matting agent: monodisperse polymethyl methacrylate having an average diameter of 5 μm | 50 mg/m² |
| Sodium di(2-ethylhexyl)sulfosuccinate | 10 mg/m² |
| Surfactant M | 50 mg/m² |
| $H(OCH_2CH_2)_{68}OH$ | 50 mg/m² |
| Hardener T | 20 mg/m² |

The compounds used in the above-mentioned are shown below.

Surfactant A

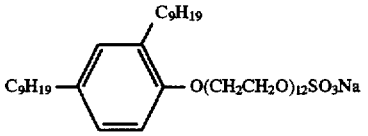

Water-soluble electroconductive polymer B

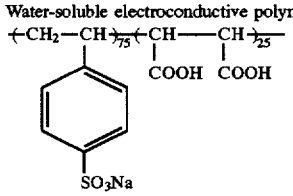

Average molecular weight: 5000

Hydrophilic polymer particle C

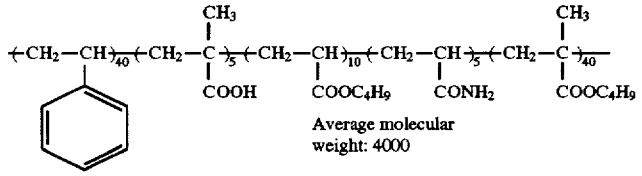

Average molecular weight: 4000

Ethylene oxide compound D $HO(CH_2CH_2O)_{15}H$ (n = 15)

Hardener E

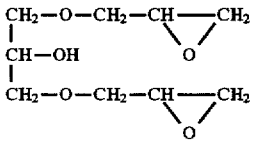

Compound F

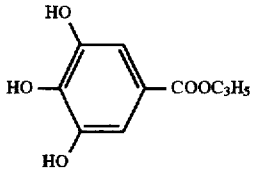

Compound I

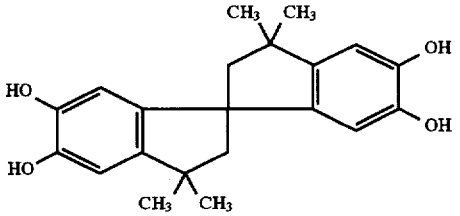

-continued
Water-soluble dye N
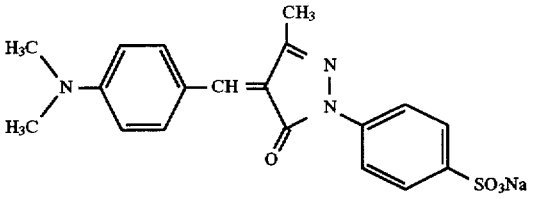
Dye O
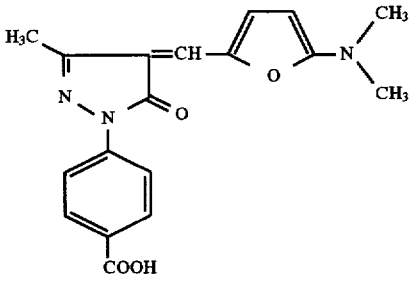
Dye G
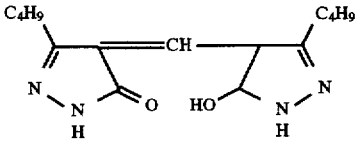
Compound J
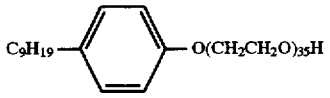
Latex polymer K
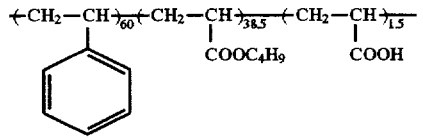
Hardener L
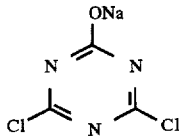
Surfactant M
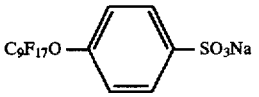
Hardener T
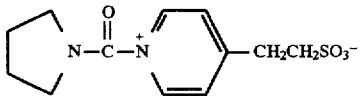
Compound U
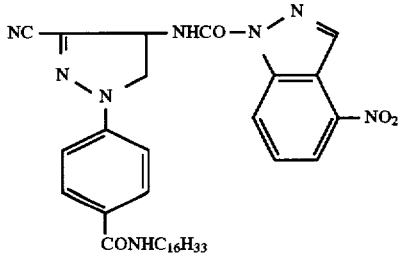

-continued

Water-soluble dye Q

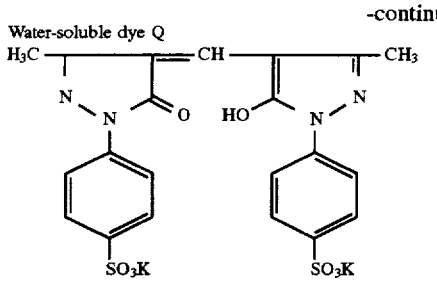

Water-soluble dye R

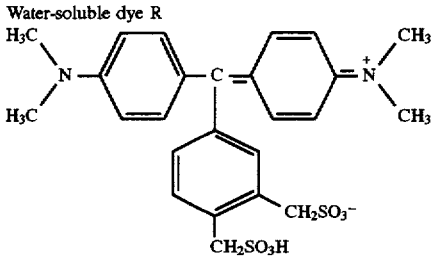

The surface resistivity of the backing side after coating and drying was $6\times10^{11}$ Ω at 23° C. and 20% of RH, and the pH of the surface of the emulsion coated side was 5.5.

(Preparation of fine solid particle dispersion of dye)

In the example of the invention, a dispersion of fine solid particle of dye prepared by the following method was used.

In a vessel with a capacity of 60 ml having a screw cap, 21.7 ml of water and 30 ml of a 6.7% solution of a surfactant, Triton X-200, manufactured by Rohm & Haas Co., were charged and 1.0 g of dye previously powdered in a mortar, a surfactant, and 40 ml of zirconium oxide beads of diameter of 2 mm were further added into the vessel. The vessel is set on a ball mill after closing the cap and the dyes was dispersed so that the diameter of particle was made to the required value. Then 8.0 g of a 12.5% gelatin solution was added and mixed, and the zirconium oxide beads were removed by filtration. Thus a dispersion of fine solid particle was prepared.

(Receipt of developing solution)

Initial developing solution (HAD-S) (for 1 liter of using solution)

| | |
|---|---|
| Pentasodium diethylenetriaminepentaacetate | 10.9 g |
| Potassium sulfite | 31.8 g |
| Sodium sulfite | 42.6 g |
| KBr | 4 g |
| $H_3BO_3$ | 8 g |
| Potassium carbonate | 112.2 g |
| 2-mercaptoadenine | 0.07 g |
| Diethylene glycol | 40 g |
| 5-mercaptobenzotriazole | 0.21 g |
| 1-phenyl-5-mercaptotetrazole | 0.03 g |
| Dimezon S (1-phenyl-4-hydroxymethyl-4-methylpyrazolidone | 0.85 g |
| Hydroquinone | 20 g |

Make up to 1000 ml by addition of purified water and KOH to adjust the pH value to 10.40.

Preparation of granulated developer replenisher (KR)

Preparation of granule Part A (for 1 liter of using solution)

| | |
|---|---|
| Pentasodium diethylenetriaminepentaacetate | 1.45 g |
| Sodium carbonate (monohydrate) | 76.27 g |
| D-mannitol (trade name, manufactured by Kao Co.) | 6.94 g |

-continued

| | |
|---|---|
| Sorbitol | 2.93 g |
| LiOH | 10 g |

The above materials were mixed in a bandom mill available on the market for 30 minutes and granulated for 10 minutes in a granulating machine available on the market. The granulated material was dried for two hours at 40° C. by a fluidizing bed dryer. Thus granule Part A having an average diameter of 3000 μm and an angle of repose of 33°.

Preparation of granule Part B (for 1 liter of using solution)

| | |
|---|---|
| Sodium sulfite | 56.58 g |
| KBr | 2 g |
| $H_3BO_3$ | 4 g |
| 2-mercaptoadenine | 0.25 g |
| 5-methylbenzotriazole | 0.26 g |
| 1-phenyl-5-mercaptotetrazole | 0.06 g |
| Dimezon S | 1.25 g |
| Hydroquinone | 20 g |
| D-mannitol (trade name, manufactured by Kao Co.) | 4.77 g |

The above materials were mixed in a bandam mill available on the market for 30 minutes and granulated for 10 minutes in a granulating machine available on the market. The granulated material was dried for two hours at 40° C. by a flowing layer drying machine. Thus granule Part B having an average diameter of 4000 μm and a angle of repose of 30°.

The above-mentioned Parts A and B were completely mixed to obtain granulated developer replenisher HAD-KR. The granulated developer replenisher was dissolved to make up to 1 liter at the time of use.

Initial fixing solution (HAF-S) (for 1 liter of using solution)

| | |
|---|---|
| Purified water | 116 ml |
| Ammonium thiosulfate | 140 g |
| Sodium sulfite | 22 g |
| Boric acid | 9.8 g |
| tartaric acid | 3 g |
| Sodium acetate trihydrate | 34 g |
| Acetic acid (90% aqueous solution) | 14.5 g |

-continued

| | |
|---|---|
| Aluminum sulfate.18 hydrate | 18 g |
| Make up with purified water to | 400 ml |

The above concentrated solution was mixed with 600 ml of purified water at the time of use. The pH value of the using solution was 4.90.

Preparation of granulated fixer replenisher (HAF-KR)

Preparation of granule Part A (for 1 liter of using solution)

| | |
|---|---|
| Ammonium thiosulfate (Na salt content: 10%, manufactured by Hoechst Co.) | 140 g |
| Sodium metabisulfite | 7.5 g |
| Sodium acetate | 40 g |
| Painflow (trade name, manufactured by Matutani Kagaku Co.) | 11.8 g |

The above materials were mixed in a bandam mill available on the market for 30 minutes and granulated for 10 minutes in a granulating machine available on the market. The granulated material was dried for two hours at 40° C. by a flowing layer drying machine. Thus granule Part A having an average diameter of 4000 μm and an angle of repose of 40'.

Preparation of granule Part B (for 1 liter of using solution)

| | |
|---|---|
| Boric acid | 10 g |
| Tartaric acid | 3 g |
| Sodium hydrogensulfate | 26.5 g |
| Aluminum sulfate.18 hydrate | 15.8 g |
| D-mannitol (trade name, manufactured by Kao Co.) | 4.4 g |
| N-lauloyltaurin (trade name, manufactured by Nikko Chemicals Co.) | 2 g |
| Demol N (trade name, manufactured by Kao Co.) | 5 g |

The above materials were mixed in a bandam mill available on the market for 30 minutes and granulated for 10 minutes in a granulating machine available on the market. The granulated material was dried for two hours at 40° C. by a flowing layer drying machine. Thus granule Part B having an average diameter of 3300 μm and an angle of repose of 28°.

The above-mentioned Parts A and B were completely mixed to prepare a granulated fixer replenisher HAF-KR. The granulated fixer replenisher was dissolved so that the volume is to be 1 liter at the time of use. The pH value of the solution was 4.20.

(Automatic processor)

A modified automatic processor GR-26SR manufactured by Konica Corp. was used. The processor has an infrared heater in the drying zone and a cover covering the whole liquid surface of the processing tanks. The replenish to the developer was carried out in a ratio of 195 ml per square meter of film processed.

(Processing condition)

| | Temperature | Time |
|---|---|---|
| Developing | 38° C. | 15 seconds |
| Fixing | 38° C. | 9 seconds |
| Washing | 38° C. | 8.5 seconds |
| Squeezing | | 2.5 seconds |
| Drying | 40° C. | 10 seconds |
| Dry to dry | | 45 seconds |
| Line speed (Transportating speed) | | 3300 mm/min. |

While the processing, the exhausted fixing solution was recycled to the fixing bath after recovering silver by a silver recovering apparatus described in Example in JP O.P.I. No. 6-27623. The overflowed water from the washing bath was treated by a fur preventing apparatus [Mizukirei] manufactured by Konica Corp.

<Evaluation method>

(Quality of white letter on halftone background)

To evaluate the reproducibility of white letter on an halftone background, an original composed of a mask film, a transparent film for pasting base, a film carrying an uniform halftone image and a film carrying a line image film piled in this order as shown in FIG. 1 was used. The original was contacted to the emulsion surface of the sample of light-sensitive material and to exposed to light in a printer P627FM using a non-electrode discharge tube light source manufactured by Fusion Co. USA. In FIG. 1, 1 is a sample of light-sensitive material to be evaluated, 2 is the film carrying an uniform halftone image, 3 and 5 are the transparent film, 4 is the film carring a positive line image and 6 is the mask film. The exposed sample was processed uner the foregoing condition. The quality of image formed on the processed sample was classified to five ranks. Rank 5 is defined as an image quality in which a letter having a line width of 30 μm is reproduced on the halftone background when the exposure is controlled so that the 50 halftone image of the original is reproduced as 50% halftone image on the sample. Rank 5 corresponds to a very high quality of image of white letter on the halftone background.

Ranks 4, 3, 2 and 1 correspond to the image quality each capable of reproducing image having a width of 60 μm or more, 90 μm or more, 120 μm or more and 150 μm or more, respectively, under the the above-mentioned exposure condition. A light-sensitive material ranked at Rank 3 or more is applicable to the practical use.

(Relative sensitivity)

The light-sensitive material sample is exposed to light through an optical wedge by the above-mentioned P627FM and processed. The sensitivity of the sample was described in a relative value of the reciprocal of exposure amount giving a density of 1.5.

(Storage ability)

The storage ability of the light-sensitive material sample was shown by the properties of the samples after standing for 3 days at a temperature of 55° C. and a relative humidity of 50%.

The density of blacken dot in the samples for evaluation of the quality of image of white letter on the halftone background. A high value of the density shows that the number of white spot is small. In the sample in which the density is less than 3.5, the white-spot is come into prominence and cannot be applied to practical use.

X-Rite 361T, (manufactured by Nihon Heihan Shizai Co.) and Macbeth densitometer were used for measuring the dot percentage and the optical density, respectively.

Results are shown in Tables 3 and 4.

TABLE 3

| Sample No. | 2nd emulsion Layer Emulsion | Gelatin (g/m²) | Thickness (μm) | Lower protective layer Gelatin (g/m²) | Thickness (μm) | Upper protective layer Gelatin (g/m²) | Thickness (μm) | Hydrazine derivative Kind | Amount (mg/m²) | nucleation accerelating agent in 1st emulsion layer: Amine compound Kind | Amount (mg/m²) | Onium compound Kind | Amount (mg/m²) |
|---|---|---|---|---|---|---|---|---|---|---|---|---|---|
| 1 | A | 0.8 | 1.6 | 0.8 | 1.4 | 0.8 | 0.6 | H-27 | 30 | — | — | — | — |
| 2 | B | 0.8 | 1.6 | 0.8 | 1.4 | 0.8 | 0.6 | H-27 | 30 | — | — | — | — |
| 3 | C | 0.8 | 1.6 | 0.8 | 1.4 | 0.8 | 0.6 | H-27 | 30 | — | — | — | — |
| 4 | D | 0.8 | 1.6 | 0.8 | 1.4 | 0.8 | 0.6 | H-27 | 30 | — | — | — | — |
| 5 | A | 0.8 | 1.6 | 0.8 | 1.4 | 0.8 | 0.6 | H-27 | 60 | — | — | — | — |
| 6 | A | 0.8 | 1.6 | 0.8 | 1.4 | 0.8 | 0.6 | H-26 | 30 | — | — | — | — |
| 7 | A | 0.3 | 1.2 | 0.3 | 1 | 0.3 | 0.2 | H-27 | 30 | Na-21 | 30 | P-56 | 30 |
| 8 | A | 2.7 | 3.1 | 2.7 | 2.9 | 2.7 | 2.1 | H-27 | 30 | Na-21 | 30 | P-56 | 30 |
| 9 | A | 3 | 3.3 | 2.7 | 2.9 | 2.4 | 1.9 | H-27 | 30 | Na-21 | 30 | P-56 | 30 |
| 10 | D | 0.8 | 1.6 | 0.8 | 1.4 | 0.8 | 0.6 | H-27 | 30 | Na-21 | 30 | P-56 | 30 |
| 11 | A | 0.8 | 1.6 | 0.8 | 1.4 | 0.8 | 0.6 | H-27 | 30 | Na-21 | 30 | P-56 | 30 |
| 12 | B | 0.8 | 1.6 | 0.8 | 1.4 | 0.8 | 0.6 | H-27 | 30 | Na-21 | 30 | P-56 | 30 |
| 13 | C | 0.8 | 1.6 | 0.8 | 1.4 | 0.8 | 0.6 | H-27 | 30 | Na-21 | 30 | P-56 | 30 |
| 14 | B | 0.8 | 1.6 | 0.8 | 1.4 | 0.8 | 0.6 | H-38 | 25 | Na-3 | 30 | — | — |
| 15 | B | 0.8 | 1.6 | 0.8 | 1.4 | 0.8 | 0.6 | H-39 | 25 | — | — | P-58 | 15 |
| 16 | B | 0.8 | 1.6 | 0.8 | 1.4 | 0.8 | 0.6 | H-40 | 25 | — | — | P-58 | 15 |
| 17 | B | 0.8 | 1.6 | 0.8 | 1.4 | 0.8 | 0.6 | H-39 | 15 | Na-3 | 10 | P-58 | 15 |
| 18 | B | 0.8 | 1.6 | 0.8 | 1.4 | 0.8 | 0.6 | H-39 | 15 | — | — | P-58 | 15 |
| 19 | B | 0.8 | 1.6 | 0.8 | 1.4 | 0.8 | 0.6 | H-38 | 15 | — | — | P-57 | 30 |
| 20 | B | 0.8 | 1.6 | 0.8 | 1.4 | 0.8 | 0.6 | H-38 | 15 | Na-3 | 30 | — | — |
| 21 | B | 1.6 | 2.2 | 1.1 | 1.6 | 0.5 | 0.4 | H-39 | 15 | — | — | P-58 | 15 |
| 22 | B | 2.7 | 3 | 1.6 | 2 | 0.8 | 0.6 | H-39 | 15 | — | — | P-58 | 30 |
| 23 | B | 0.8 | 1.6 | 0.8 | 1.4 | 0.8 | 0.6 | H-39 | 15 | — | — | P-58 | 15 |
| 24 | B | 0.8 | 1.6 | 0.8 | 1.4 | 0.8 | 0.6 | H-39 | 15 | — | — | P-58 | 15 |
| 25 | B | 0.8 | 1.6 | 0.8 | 1.4 | 0.8 | 0.6 | H-39 | 15 | — | — | P-58 | 15 |
| 26 | B | 0.8 | 1.6 | 0.8 | 1.4 | 0.8 | 0.6 | H-27 | 30 | Na-21 | 30 | P-56 | 30 |

TABLE 4

| Sample No. | Nuclei formation accerelating agent in 2nd Emulsion layer: Amine compound Kind | Amount (mg/m²) | Onium compound Kind | Amount (mg/m²) | Particle size of matting agent (μm) | Drying condition I (°C.) | II (°C.) | Before storage at high temp. & humid: Sensitivity | White letter | After storage at high temp. & humid: Sensitivity | White letter | White spots (Density) | Note |
|---|---|---|---|---|---|---|---|---|---|---|---|---|---|
| 1 | — | — | — | — | 7 | 15 | 35 | 100 | 2 | 140 | 1 | 3.5 | Comp. |
| 2 | — | — | — | — | 7 | 15 | 35 | 98 | 2.5 | 136 | 1.5 | 3.6 | Comp. |
| 3 | — | — | — | — | 7 | 15 | 35 | 109 | 2 | 146 | 1 | 3.5 | Comp. |
| 4 | — | — | — | — | 7 | 15 | 35 | 140 | 1 | 160 | 1 | 2.5 | Comp. |
| 5 | — | — | — | — | 7 | 15 | 35 | 115 | 2 | 148 | 1 | 3.7 | Comp. |
| 6 | — | — | — | — | 7 | 15 | 35 | 101 | 1.5 | 140 | 1 | 3.6 | Comp. |
| 7 | Na-22 | 30 | — | — | 7 | 15 | 35 | 110 | 2.5 | 115 | 1.5 | 2.2 | Comp. |
| 8 | Na-22 | 30 | — | — | 7 | 15 | 35 | 107 | 2 | 111 | 1.5 | 4.5 | Comp. |
| 9 | Na-22 | 30 | — | — | 7 | 15 | 35 | 106 | 2 | 110 | 1.5 | 4.6 | Comp. |
| 10 | Na-22 | 30 | — | — | 7 | 15 | 35 | 145 | 1.5 | 165 | 1.5 | 3.5 | Comp. |
| 11 | Na-22 | 30 | — | — | 7 | 15 | 35 | 105 | 3.5 | 108 | 3.5 | 4.9 | Inv. |
| 12 | Na-22 | 30 | — | — | 7 | 15 | 35 | 100 | 4.5 | 100 | 4.5 | 5.5 | Inv. |
| 13 | Na-22 | 30 | — | — | 7 | 15 | 35 | 112 | 3.5 | 114 | 3 | 5.7 | Inv. |
| 14 | — | — | P-59 | 30 | 7 | 15 | 35 | 104 | 4.5 | 100 | 4.5 | 5.5 | Inv. |
| 15 | Na-3 | 15 | — | — | 7 | 15 | 35 | 96 | 5 | 95 | 5 | 5.9 | Inv. |
| 16 | Na-3 | 15 | P-59 | 15 | 7 | 10 | 25 | 105 | 5 | 104 | 4.5 | 5.2 | Inv. |
| 17 | Na-3 | 15 | P-59 | 15 | 7 | 10 | 25 | 99 | 5 | 101 | 4.5 | 5.5 | Inv. |
| 18 | Na-3 | 15 | P-60 | 10 | 5 | 15 | 35 | 101 | 5 | 98 | 5 | 6 | Inv. |
| 19 | — | — | — | — | 9 | 15 | 35 | 95 | 4.5 | 97 | 4.5 | 5.1 | Inv. |
| 20 | — | — | — | — | 7 | 19 | 35 | 96 | 4.5 | 101 | 4 | 5.2 | Inv. |
| 21 | Na-3 | 30 | — | — | 7 | 19 | 35 | 110 | 5 | 107 | 4.5 | 5.3 | Inv. |
| 22 | Na-3 | 15 | — | — | 7 | 15 | 35 | 103 | 5 | 104 | 5 | 5.4 | Inv. |
| 23 | Na-3 | 15 | — | — | 3 | 15 | 35 | 106 | 3.5 | 107 | 3.5 | 5.7 | Inv. |
| 24 | Na-3 | 15 | — | — | 11 | 15 | 35 | 104 | 4 | 105 | 4 | 4 | Inv. |

TABLE 4-continued

| Sample No. | Nuclei formation accerelating agent in 2nd Emulsion layer: Amine compound Kind | Amount (mg/m²) | Onium compound Kind | Amount (mg/m²) | Particle size of matting agent (μm) | Drying condition I (°C.) | II (°C.) | Before storage at high temp. & humid: Sensitivity | White letter | After storage at high temp. & humid: Sensitivity | White letter | White spots (Density) | Note |
|---|---|---|---|---|---|---|---|---|---|---|---|---|---|
| 25 | Na-3 | 15 | — | — | 7 | 25 | 35 | 97 | 4.5 | 96 | 4.5 | 4.1 | Inv. |
| 26 | Na-22 | 30 | — | — | 7 | 15 | 35 | 130 | 3.5 | 135 | 3 | 3.7 | Inv.* |

White letter: Quality of white letter on the half tone background
*Sample 26 is the same as Sample 12 except that Dyes O and G are omitted.

As is understood from Tables 3 and 4, the quality of white letter on the halftone background is excellent and the defect of white spots is inhibited in the samples of the invention Nos. 11 to 26. Variation in the sensitivity and degradation in the white letter quality on the halftone background caused by the storage at the humid and high temperature condition are also small. The quality of white letter on the halftone background is improved by the use of a matting agent having an average diameter within the range of 4 μm to 10 μm, and white spots defects are decreased by applying the drying condition of the invention. Further, the image quality of white letter on the halftone background is improved and white spot defects are decreased when the dye dispersed in the form of solid particle is contained.

Example 2

Results similar to those of Examples 1 were obtained when the support in Example 1 was replaced by a support coated with the following subbing layer and antistatic layer.

(Subbing layer and antistatic layer)

A polyethylene terephthalate support having a thickness of 100 ∞m, which was subbed with vinylidene chloride on both sides, was subjected to 10 W/(m².min.) of corona discharge and then, an antistatic layer having the following composition was coated on one side of the support.

| | |
|---|---|
| Gelatin | 0.5 g/m² |
| $SnO_2$/Sb (weight ratio: 9/1, average particle diameter: 0.2 μ) | 150 mg/m² |
| Sodium dodecylbenzenesulfate | 10 mg/m² |
| Sodium dihexyl-α-sulfosuccinate | 40 mg/m² |
| Sodium polystyrene sulfonate | 9 mg/m² |
| Glyoxal | 10 mg/m² |

Example 3

Similar results to Example 1 were obtained even when the following SPS support was used in place of the polyethylene terephthalate support in Example 1.

(Preparation of support)

(Synthesis of SPS)

In 200 parts by weight of toluene, 100 parts by weight of styrene, 56 g of truisobutylaluminum and 234 g of pentamethylcyclopentadiethyltitanium trimethoxide were reacted for 6 hours at 96° C. Then the catalyst was decomposed and removed by a methanol solution of sodium hydroxide. Thirty four parts by weight of the objective compound (SPS) was obtained by washing the reacted matter with methanol for three times.

(Preparation of SPS film)

A unstretched film was prepared by melt-extruding thus obtained SPS at 330° C. through a T die and rapidly solidifying by chilling. At this time, the take up speed of the chilling drum was varied to two grade, thus unstretched films each having a thickness of 1370 μm and 1054 μm were obtained. The films were each preheated at 135° C. and stretched longitudinadireby 3.1 times, then stretched in the cross direction by 3.4 times at 130° C. The films were thermally fixed after the stretching at 250° C. Thus diaxially stretched films having a bending elasticity of 450 kg/mm² and a thickness of 130 μm or 100 μm were obtained.

(Subbing of the SPS film)

The subbing layer and the antistatic layer described in Example 1 were coated on the above-mentioned SPS film, after a silica layer was provided by evaporation on the surface of the film.

What is claimed is:

1. A black-and-white silver halide photographic light-sensitive material comprising a support having thereon a light-sensitive silver halide emulsion layer and at least two non-light-sensitive hydrophilic colloid layers provided on the surface of the silver halide emulsion layer farther from said support, wherein the silver halide emulsion layer comprises silver halide grains each having a silver chloride content of 90 mole-% to 100 mole-% and containing a metal selected from the group consisting of transition metal of Group VIII of the periodic table and rhenium.

a layer provided on the emulsion layer coated side of the support contains a hydrazine derivatives and a layer provided on the emulsion layer coated side of the support contains an amine compound or an onium compound as a nucleation accelerating agent, and the total dry thickness of layers provided on the surface farther from the support said hydrophilie layers is 2.5 μm to 8 μm.

2. The light-sensitive material of claim 1, wherein at least one silver halide emulsion layer is further contained in the layer provided on said silver halide emulsion layer.

3. The light-sensitive material of claim 1, wherein at least one of said non-light-sensitive hydrophilic colloid layer contains a matting agent having an average diameter of 4 μm to 10 μm.

4. The light-sensitive material of claim 1, wherein at least one of said non-light-sensitive hydrophilic colloid layer contains solid dispersion particles of a dye.

5. The light-sensitive material of claim 1, wherein the layers coated on the emulsion side of the support are dried under a condition of wet-bulb temperature of not higher than 20° C. while the ratio of water to gelatin in the layers is decreased to 200% in the drying process.

6. The light-sensitive material of claim 1 wherein said total dry thickness is 3 to 5 μm.

7. The light-sensitive material of claim 1 wherein said total dry thickness is 2 to 12 times a thickness of an outermost of said hydrophilic layers.

8. The light-sensitive material of claim 1 wherein said total dry thickness is 4 to 10 times a thickness of an outermost of said hydrophilic layers.

* * * * *